US010591154B2

(12) United States Patent
Matsumoto et al.

(10) Patent No.: US 10,591,154 B2
(45) Date of Patent: Mar. 17, 2020

(54) COMBUSTION BURNER AND BOILER

(71) Applicant: MITSUBISHI HITACHI POWER SYSTEMS, LTD., Yokohama-shi, Kanagawa (JP)

(72) Inventors: Keigo Matsumoto, Tokyo (JP); Kazuhiro Domoto, Yokohama (JP); Yukihiro Tominaga, Tokyo (JP); Ryuichiro Tanaka, Yokohama (JP); Naofumi Abe, Yokohama (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 58 days.

(21) Appl. No.: 15/553,307

(22) PCT Filed: Feb. 22, 2016

(86) PCT No.: PCT/JP2016/054978

§ 371 (c)(1),
(2) Date: Aug. 24, 2017

(87) PCT Pub. No.: WO2016/158079

PCT Pub. Date: Oct. 6, 2016

(65) Prior Publication Data

US 2018/0045404 A1 Feb. 15, 2018

(30) Foreign Application Priority Data

Mar. 31, 2015 (JP) ..... 2015-073500
Sep. 11, 2015 (JP) ..... 2015-179763

(51) Int. Cl.
*F23C 5/08* (2006.01)
*F23D 1/00* (2006.01)
(Continued)

(52) U.S. Cl.
CPC ..... *F23C 5/08* (2013.01); *F23C 5/12* (2013.01); *F23D 1/00* (2013.01); *F23K 3/02* (2013.01);
(Continued)

(58) Field of Classification Search
CPC ..... F23C 5/08; F23C 5/12; F23C 2700/063; F23D 1/00; F23D 2201/20; F23D 11/406; F23K 3/02; F22B 13/02
(Continued)

(56) References Cited

U.S. PATENT DOCUMENTS 766,494 A * 8/1904 Crone ..... B05B 7/066 239/424
1,103,253 A * 7/1914 Bennett ..... B05B 1/267 239/429
(Continued)

FOREIGN PATENT DOCUMENTS

CN 2281479 Y 5/1998
CN 2415254 Y 1/2001
(Continued)

OTHER PUBLICATIONS

"WO_2012137573_A1_M—Machine Translation.pdf", machine translation, Espacenet / epo.org, Mar. 14, 2019.*
(Continued)

*Primary Examiner* — Steven B McAllister
*Assistant Examiner* — Daniel E. Namay
(74) *Attorney, Agent, or Firm* — Westerman, Hattori, Daniels & Adrian, LLP

(57) ABSTRACT

A combustion burner including: a fuel nozzle (61) which ejects a fuel gas that is a mixture of fuel and air; a combustion air nozzle (62) which ejects air from an outer side of the fuel nozzle (61); first members (71) which are arranged inside the fuel nozzle (61) and which each com-
(Continued)

prise a first inclined surface (82*a*) inclined with respect to the flow of the fuel gas, and a first inclination end edge where the inclination of the first inclined surface (82*a*) ends; and second members (72) which are arranged downstream of the first inclination end edges in the direction of fuel gas flow, and which each comprise a second inclined surface (84*a*) inclined towards the first members (71) with respect to the fuel gas flow and a second inclination end edge where the inclination of the second inclined surface (84*a*) ends.

13 Claims, 17 Drawing Sheets

(51) Int. Cl.
*F23K 3/02* (2006.01)
*F23D 11/40* (2006.01)

(52) U.S. Cl.
CPC ..... *F23C 2700/063* (2013.01); *F23D 11/406* (2013.01); *F23D 2201/20* (2013.01)

(58) Field of Classification Search
USPC ..... 431/8, 171, 350
IPC ..... F23C 5/08; F23D 1/00,11/40; F23K 3/02
See application file for complete search history.

(56) References Cited

U.S. PATENT DOCUMENTS 1,887,330 A * 11/1932 Shaw ..... F23D 14/04 126/114
2,149,980 A * 3/1939 Paret, Jr. ..... F23D 14/22 137/625.11
2,259,010 A * 10/1941 Taylor ..... F23C 99/00 431/347
2,360,548 A * 10/1944 Conway ..... F23D 14/22 431/186
2,895,435 A * 7/1959 Bogot ..... F23D 1/00 239/424
3,112,988 A * 12/1963 Coldren ..... B01F 5/0416 137/13
3,195,606 A * 7/1965 Stout ..... F23D 11/00 432/212
3,209,811 A * 10/1965 Strang ..... C21D 9/70 431/181
3,213,919 A * 10/1965 Calzolari ..... F23D 11/10 239/488
3,823,875 A * 7/1974 Bauer ..... F23D 1/00 239/419.5
4,284,402 A * 8/1981 Sheets ..... F23M 9/06 431/171
4,520,739 A * 6/1985 McCartney ..... F23D 1/00 110/263
4,634,054 A 1/1987 Grusha
5,215,259 A 6/1993 Wark
5,231,937 A 8/1993 Kobayashi et al.
5,292,246 A * 3/1994 Gateau ..... F23D 14/22 239/418
5,483,906 A 1/1996 Hufton
5,529,000 A 6/1996 Hartel et al.
5,782,626 A * 7/1998 Joos ..... F23D 11/007 431/181
6,003,793 A * 12/1999 Mann ..... F23D 1/00 110/264
6,089,171 A 7/2000 Fong et al.
6,158,223 A 12/2000 Mandai et al.
6,334,770 B1 * 1/2002 Giraud ..... C21D 9/0006 431/165
6,461,145 B1 * 10/2002 Giraud ..... F23D 14/22 431/10
6,579,085 B1 * 6/2003 Satchell, Jr. ..... F23D 14/22 239/403
7,163,392 B2 * 1/2007 Feese ..... F23C 6/045 431/10
7,500,849 B2 * 3/2009 Dudill ..... F23D 11/102 239/418
8,070,484 B2 * 12/2011 Just ..... F23D 1/00 431/12
8,105,075 B2 * 1/2012 Huau ..... E21B 41/0071 239/401
8,393,892 B2 * 3/2013 Hagihara ..... F23D 14/24 264/15
9,546,784 B2 1/2017 Van Der Ploeg et al.
2008/0206696 A1 * 8/2008 Wark ..... F23D 1/00 431/202
2008/0268387 A1 * 10/2008 Saito ..... F23R 3/286 431/8
2009/0214989 A1 * 8/2009 Swanson ..... F23C 6/047 431/8
2009/0220899 A1 * 9/2009 Spangelo ..... F23D 14/22 431/8
2009/0277364 A1 11/2009 Donais et al.
2010/0044282 A1 * 2/2010 Zarnescu ..... B01F 5/061 209/629
2010/0064986 A1 3/2010 Kiyama et al.
2012/0171629 A1 * 7/2012 Kang ..... F23C 9/006 431/8
2012/0247376 A1 10/2012 Matsumoto et al.
2013/0291770 A1 11/2013 Kashima et al.
2014/0011141 A1 1/2014 Matsumoto et al.
2014/0227647 A1 * 8/2014 Mueller-Hagedorn ..... C01B 3/363 431/8
2015/0068438 A1 3/2015 Taniguchi et al.
2016/0010853 A1 1/2016 Matsumoto et al.
2016/0356489 A1 12/2016 Matsumoto et al.
2016/0356490 A1 12/2016 Matsumoto et al.
2016/0356494 A1 12/2016 Matsumoto et al.
2017/0045221 A1 2/2017 Matsumoto et al.

FOREIGN PATENT DOCUMENTS

CN 1 407 274 A 4/2003
CN 201302156 Y 9/2009
CN 102620291 A 8/2012
CN 202938290 U 5/2013
CN 103267282 A 8/2013
CN 103443543 A 12/2013
CN 103672883 A 3/2014
CN 203718765 U 7/2014
CN 104100969 A 10/2014
EP 0035153 A1 * 9/1981 ..... F23D 14/04
EP 0 129 001 A1 12/1984
EP 2 267 365 A2 12/2010
EP 2 518 404 A1 10/2012
EP 2659186 A2 11/2013
EP 2 696 139 A1 2/2014
JP 58110907 A * 7/1983 ..... F23D 17/00
JP 59009414 A * 1/1984 ..... F23C 5/08
JP 59077206 A * 5/1984 ..... F23C 5/08
JP 59-205510 11/1984
JP 60103207 A * 6/1985 ..... F23D 1/00
JP 1-217109 A 8/1989
JP 4-24404 A 1/1992
JP 8-135919 A 5/1996
JP 9-203505 A 8/1997
JP 11-072230 A 3/1999
JP 11-281010 A 10/1999
JP 2009-204256 A 9/2009
JP 2010-270992 A 12/2010
JP 2011-149676 A 8/2011
JP 2012-122653 A 6/2012
JP 2012-215362 A 11/2012
JP 2012-215363 A 11/2012
JP 2015-52450 A 3/2015
WO 2008/038426 A1 4/2008
WO 2012/098848 A1 7/2012
WO 2012-137573 A1 10/2012

(56) References Cited

FOREIGN PATENT DOCUMENTS

OTHER PUBLICATIONS

Office Action dated Dec. 18, 2018, issued in KR Application No. 10-2017-7036865, (counterpart to U.S. Appl. No. 15/736,108) with English translation (12 pages).
Office Action dated Aug. 2, 2018. issued in counterpart Chinese Application No. 201680011710.1, with English translation (12 pages).
Office Action dated Sep. 20, 2018, issued in counterpart Korean Application No. 10-2017-7021755, with English translation (13 pages).
Extended Search Report dated Feb. 12, 2018, issued in European Application No. 16771965.7 (7 pages).
Extended Search Report dated Jun. 20, 2018, issued in European Application No. 16844082.4 (10 pages).
Extended Search Report dated Jun. 22, 2018, issued in counterpart European Application No. 16771963.2 (7 pages).
International Search Report dated Apr. 19, 2016, issued in International Application No. PCT/JP2016/055008 (5 pages).
International Search Report dated Sep. 20, 2016, issued in International Application No. PCT/JP2016/072564 (5 pages).
Office Action dated Jun. 5, 2018, issued in counterpart Japanese Application No. 2017-509377, with English translation (13 pages).
Office Action dated Jun. 5, 2018, issued in Japanese Application No. 2017-509379, with English translation (11 pages).
Written Opinion dated Sep. 20, 2016, issued in Application No. PCT/JP2016/072564 (10 pages).
Written Opinion dated Apr. 19, 2016, issued in Application No. PCT/JP2016/055008 (7 pages).
International Search Report dated Apr. 19, 2016, issued in counterpart International Application No. PCT/JP2016/054978, with English translation (4 pages).
Written Opinion dated Apr. 19, 2016, issued in counterpart International Application No. PCT/JP2016/054978, with English translation (10 pages).
Office Action dated Jun. 3, 2019, issued in CN Application No. 201680037949.6, with English translation (10 pages).
Office Action dated Aug. 2, 2019, issued in counterpart IN application No. 201747027882, with English translation. (6 pages).
Quayle Action dated Mar. 8, 2019, issued in U.S. Appl. No. 15/553,273 (9 pages).
Office Action dated Mar. 13, 2019, issued in CN application No. 201680011710.1(counterpart to U.S. Appl. No. 15/553,273), with English translation. (11 pages).
Office Action dated Jan. 10, 2020, issued in counterpart CN application No. 201680011710.1, with English translation. (17 pages).

* cited by examiner

COMBUSTION BURNER AND BOILER

TECHNICAL FIELD

The present invention relates to a combustion burner that mixes fuel and air and combusts the mixture and a boiler that generates steam with combustion gas produced by the combustion burner.

BACKGROUND ART

A conventional coal-fired boiler includes a furnace that is hollow and is installed in the vertical direction and a plurality of combustion burners that are disposed in the wall of the furnace in the circumferential direction in a plurality of vertical rows. The combustion burners are supplied with a fuel-air mixture of pulverized coal (fuel) obtained by pulverizing coal and primary air and with secondary air at high temperature, and inject the fuel-air mixture and secondary air into the furnace to form flames. This operation enables combustion in the furnace. The furnace is connected with a flue at an upper portion. The flue is provided with heat exchangers, such as a superheater, a reheater, and a fuel economizer, for collecting heat of flue gas, and heat is exchanged between the flue gas produced by combustion in the furnace and water, thereby generating steam.

Examples of such a combustion burner of the coal-fired boiler are disclosed in the Patent Documents described below. The combustion burners disclosed in the Patent Documents each include a fuel nozzle through which fuel gas obtained by mixing pulverized coal and primary air can be blown, a secondary air nozzle through which secondary air can be blown from the exterior of the fuel nozzle, and a flame stabilizer that is provided on an axial center side at a distal end of the fuel nozzle. The flow of concentrated pulverized coal collides with the flame stabilizer to stably enable low NOx combustion in a wide load range.

CITATION LIST

Patent Document

Patent Document 1: JP-A-2012-215362
Patent Document 2: JP-A-2012-215363

SUMMARY OF INVENTION

Technical Problems

In the above-described conventional combustion burner, the flame stabilizer is shaped like a splitter and is disposed at the distal end of the fuel nozzle, so that a recirculation region is formed downstream of the flame stabilizer, and thus combustion of the pulverized coal is maintained. The splitter installed inside enables ignition occurring from the inside of flames having a smaller amount of air and reduces a high-temperature high-oxygen region formed in the outer peripheries of flames, resulting in an NOx reduction. Unfortunately, the front end surface of the flame stabilizer is in the same position as the opening of the fuel nozzle in the flow direction of the fuel gas, and the flow rate of the fuel gas thus increases at the opening of the fuel nozzle. This may lower ignitability and flame stability. For example, in Patent Document 1, a flow straightening member is provided between the inner wall surface of the fuel nozzle and the flame stabilizer to reduce the flow rate. In Patent Document 2, a guide member is provided that leads the fuel gas flowing in the fuel nozzle to the axial center side to reduce the flow rate. Unfortunately, the guide member provided, as a new member, on the outer periphery of the nozzle in the fuel nozzle increases the size and manufacturing cost of the fuel nozzle. In Patent Document 2, ignition occurs on the outer peripheral side, so that inside flame stabilizing may be inhibited. Patent Document 1 describes a flow straightening member functioning as a flame stabilizer and having a shorter length while retracting toward the upstream side. Unfortunately, since the flow straightening member having a shorter length while retracting toward the upstream side is disposed on an outer side of the flame stabilizer, the flame stability on the outer side the fuel nozzle is improved, and the secondary air thus increases temperature on the outer peripheries of combustion flames under a high-oxygen atmosphere, resulting in an increase in NOx emission.

In order to solve the above-described problems, an object of the present invention is to provide a combustion burner and a boiler capable of improving inside flame stabilizing performance.

Solution to Problem

To achieve the above-described object, a combustion burner according to one aspect of the present invention includes: a fuel nozzle ejecting a fuel gas being a mixture of fuel and air; a combustion air nozzle ejecting air from the outer side of the fuel nozzle; a first member arranged inside the fuel nozzle and including a first inclined surface inclined with respect to a flow of the fuel gas and a first inclination end edge, the first inclined surface ending inclination at the first inclination end edge; and a second member arranged downstream of the first inclination end edge in a direction of the fuel gas flow and including a second inclined surface inclined toward the first member with respect to the fuel gas flow and a second inclination end edge, the second inclined surface ending inclination at the second inclination end edge.

The fuel gas is deflected by the first inclined surface of the first member inclined with respect to the fuel gas flow, and then the fuel gas flow is separated at the first inclination end edge where the inclination of the first inclined surface ends, thereby forming a recirculation region of the fuel gas downstream of the first member. Ignition occurs to form flames in this recirculation region, and thus the flames are stabilized. The fuel gas flow is then deflected toward the first member by the second inclined surface of the second member disposed downstream of the first inclination end edge in the fuel gas flow direction, thereby guiding the fuel gas to the recirculation region formed with the first member. In this case, the first member functions as a flame stabilizer, and the second member functions as a guide member guiding the fuel gas. This configuration enhances flame stabilizing with the first member.

Alternatively, the fuel gas is deflected by the second inclined surface of the second member inclined with respect to the fuel gas flow, and then the fuel gas flow is separated at the second inclination end edge where the inclination of the second inclined surface ends, thereby forming a recirculation region of the fuel gas downstream of the second member. Ignition occurs to form flames in this recirculation region, and thus the flames are stabilized. The fuel gas flow is then deflected toward the second member by the first inclined surface of the first member disposed upstream of the second inclination end edge in the fuel gas flow direction, thereby guiding the fuel gas to the recirculation region formed with the second member. In this case, the first member functions as a guide member guiding the fuel gas, and the second member functions as a flame stabilizer. This configuration enhances flame stabilizing with the second member.

Alternatively, the first member and second member function as both the flame stabilizers and guide members. These functions are properly used depending on the positional relationship between the first member and the second member and the like. For example, if the recirculation region formed with the first member is on the extension of the second inclined surface of the second member, the second member functions as the guide member.

If the first inclined surface and second inclined surface are disposed in different positions in the fuel gas flow direction, the area of the flow path occupied by the first inclined surface and second inclined surface can be shifted in the fuel gas flow direction, and the cross-sectional area of the flow path can thus be prevented from decreasing as much as possible. As a result, an increase in the flow rate of the fuel gas can be suppressed without increasing the size of the fuel nozzle. This configuration allows the flow rate of the fuel gas to approach a firing rate and thus prevents the flames to be blown out, resulting in better flame stabilizing.

As described above, the first member disposed upstream of the second member in the fuel nozzle enhances inside flame stabilizing performed inside the fuel nozzle, resulting in promotion of reductive combustion under a shortage of oxygen and an NOx reduction.

Note that the first inclination end edge where the inclination of the first inclined surface ends and the second inclination end edge where the inclination of the second inclined surface ends each refer to an end where the separation of the fuel gas flowing along the inclined surface starts, for example, a corner being an end where an inclined surface of a triangular cross section ends or an end of a planar object where an inclined surface formed by bending the planar object ends.

The air ejected from the combustion air nozzle may advance straight in the ejected direction of the fuel gas. This configuration makes the air to be difficult to flow toward the ejection opening of the fuel nozzle and thus prevents outside flame stabilizing in the fuel nozzle, resulting in a reduction in NOx emission.

In a combustion burner according to one aspect of the present invention, a plurality of the second members are disposed on both sides of the first member.

The second members disposed on both sides of the first member allow the fuel gas to be guided from the second members to the recirculation region formed downstream of the first member, resulting in enhancement of ignition and flame stabilizing.

In a combustion burner according to one aspect of the present invention, the second member is disposed in a vicinity of an opening of the fuel nozzle at predetermined intervals from an inner wall surface of the fuel nozzle.

The second member disposed in the vicinity of the ejection opening at predetermined intervals from the inner wall surface of the fuel nozzle prevents outside ignition that the fuel gas flowing along the inner wall surface of the fuel nozzle is ignited with the combustion air flowing on the outer side of the fuel nozzle, resulting in a reduction in NOx emission.

In a combustion burner according to one aspect of the present invention, the first member includes a plurality of the first inclined surfaces spreading an ejected direction of the fuel gas in at least two directions; and the second member includes the second inclined surface disposed only on a side close to the first member.

The fuel gas is widened in the at least two directions by the first inclined surfaces of the first member to form the recirculation region, and is widened only on the first member side by the second inclined surface of the second member to form the recirculation region, resulting in prevention of outside flame stabilizing in the fuel nozzle and a reduction in NOx emission.

A plurality of the first members may be provided parallel at predetermined intervals, or a single first member may be provided along the central axial line of the fuel nozzle.

A combustion burner according to one aspect of the present invention further includes a third member disposed downstream of the first inclination end edge in the fuel gas flow direction between a plurality of the first members, the third member including third inclined surfaces inclined toward the first members with respect to the fuel gas flow and third inclination end edges, the third inclined surfaces ending inclination at the third inclination end edges.

The third member disposed between the first members downstream in the fuel gas flow direction allows the fuel gas to be supplied from the third member to the recirculation region formed with the first member, resulting in an improvement in inside flame stabilizing performance.

In a combustion burner according to one aspect of the present invention, the first member is provided so that a position thereof is adjustable in the fuel gas flow direction.

The first member of which position is adjustable in the fuel gas flow direction ensures favorable inside flame stabilizing performance by, for example, changing the position of the first member toward the upstream or downstream side in the fuel gas flow direction depending on the type of fuel.

In a combustion burner according to one aspect of the present invention, the first member and the second member are oriented in a vertical direction and arranged at predetermined intervals in a horizontal direction.

The first member and second member oriented in the vertical direction prevent the fuel contained in the fuel gas flowing in the fuel nozzle from being accumulated on the members, resulting in prevention of a reduction in flame stabilizing performance.

In a combustion burner according to one aspect of the present invention, the first member and the second member are oriented in the horizontal direction and arranged at predetermined intervals in the vertical direction.

The first member and second member oriented in the horizontal direction can relatively weaken outside ignition in the vertical direction and if the secondary air nozzle is disposed above and below, can reduce a high-temperature high-oxygen region due to air from the secondary air nozzle.

A combustion burner according to one aspect of the present invention further includes a secondary air nozzle ejecting air from the outer side of the combustion air nozzle and disposed at least on both sides in an inclination direction of the first inclined surface of the first member in the fuel nozzle.

Ejection of the secondary air outward of the fuel nozzle, which do not perform outside flame stabilizing, allows air to be supplied to the outer peripheries of the flames without increasing NOx emission even if these regions have excess oxygen. When a coal fuel, such as pulverized coal, is used, an air shortage may produce hydrogen sulfide, resulting in corrosion of the furnace wall. However, the secondary air nozzle can sufficiently supply air to the outer peripheries of the flames and can thus prevent hydrogen sulfide from being produced.

A combustion burner according to one aspect of the present invention further includes a rectifying plate extending from a first end portion to a second end portion of the fuel nozzle.

If the angle of the fuel nozzle is adjusted with an angle adjustment function of the combustion burner, the rectifying plate extending from the first end portion to the second end portion of the fuel nozzle can guide the fuel gas along the rectifying plate, thereby yielding a desired flow.

The rectifying plate is preferably provided so as to extend orthogonal to the direction in which the angle of the fuel nozzle is adjusted.

In a combustion burner according to one aspect of the present invention, a plurality of the rectifying plates are disposed at both ends of the first member and the second member in the fuel gas flow direction.

The rectifying plates disposed at both ends of the first member and second member in the fuel gas flow direction can guide the fuel gas to the flow path sandwiched between the rectifying plates, resulting in an improvement in flame stabilizing performance of the first member and second member.

In a combustion burners according to one aspect of the present invention, the distance between the facing rectifying plates gradually expands toward a downstream side in the fuel gas flow direction.

The distance between the facing rectifying plates gradually expanding toward the downstream side in the fuel gas flow direction reduces the flow rate of the fuel gas flowing along the first member and second member, resulting in a further improvement in the flame stabilizing function.

A combustion burners according to one aspect of the present invention further includes a pulverized coal tube connected with the upstream end of the combustion air nozzle, the pulverized coal tube having a distal end formed so that a cross-sectional area of a flow path expands toward the downstream side in the fuel gas flow direction, and the pulverized coal tube including a plurality of plate members at the distal end.

The plate members disposed at the distal end of the pulverized coal tube occupy the flow path at the distal end of the pulverized coal tube and can thus reduce the cross-sectional area of the flow path at the distal end of the pulverized coal tube. This configuration can prevent a decrease in the flow rate at the distal end of the pulverized coal tube and can thus prevent the solid fuel (pulverized coal) in the fuel gas from being accumulated at the distal end of the pulverized coal tube or on the upstream side of the fuel gas flow in the fuel nozzle.

A boiler according to one aspect of the present invention includes: a furnace that is a hollow and installed in a vertical direction; the combustion burner according to any one of the above aspects, disposed at the furnace; and a flue disposed at an upper portion of the furnace.

A boiler according to one aspect of the present invention further includes an additional air supplier disposed above the combustion burner at the furnace.

Advantageous Effects of Invention

The cross-sectional area of the flow path in the fuel nozzle can be prevented from decreasing as much as possible, and the flow rate of the fuel gas can be prevented from increasing without increasing the size of the fuel nozzle. This configuration allows the flow rate of the fuel gas to approach a firing rate and thus prevents the flames to be blown out, resulting in better flame stabilizing. Since inside flame stabilizing is enhanced in the fuel nozzle, reductive combustion is promoted under a shortage of oxygen, resulting in an NOx reduction.

DESCRIPTION OF EMBODIMENTS

Preferred embodiments of a combustion burner and a boiler according to the present invention are described in detail below with reference to the attached drawings. Note that the present invention is not limited by these embodiments, and, when there are a plurality of embodiments, includes combinations of those various embodiments.

First Embodiment

Figure 3:
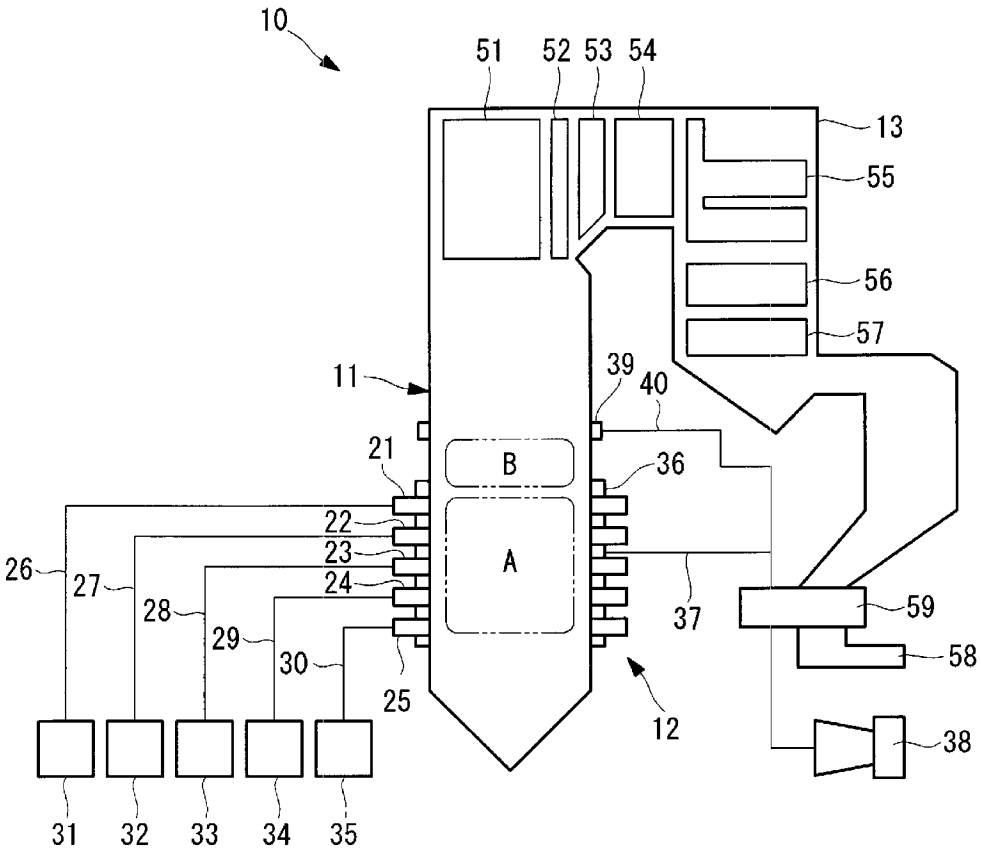
FIG. 3 is a schematic configuration diagram illustrating a coal-fired boiler according to the first embodiment.
Figure 4:
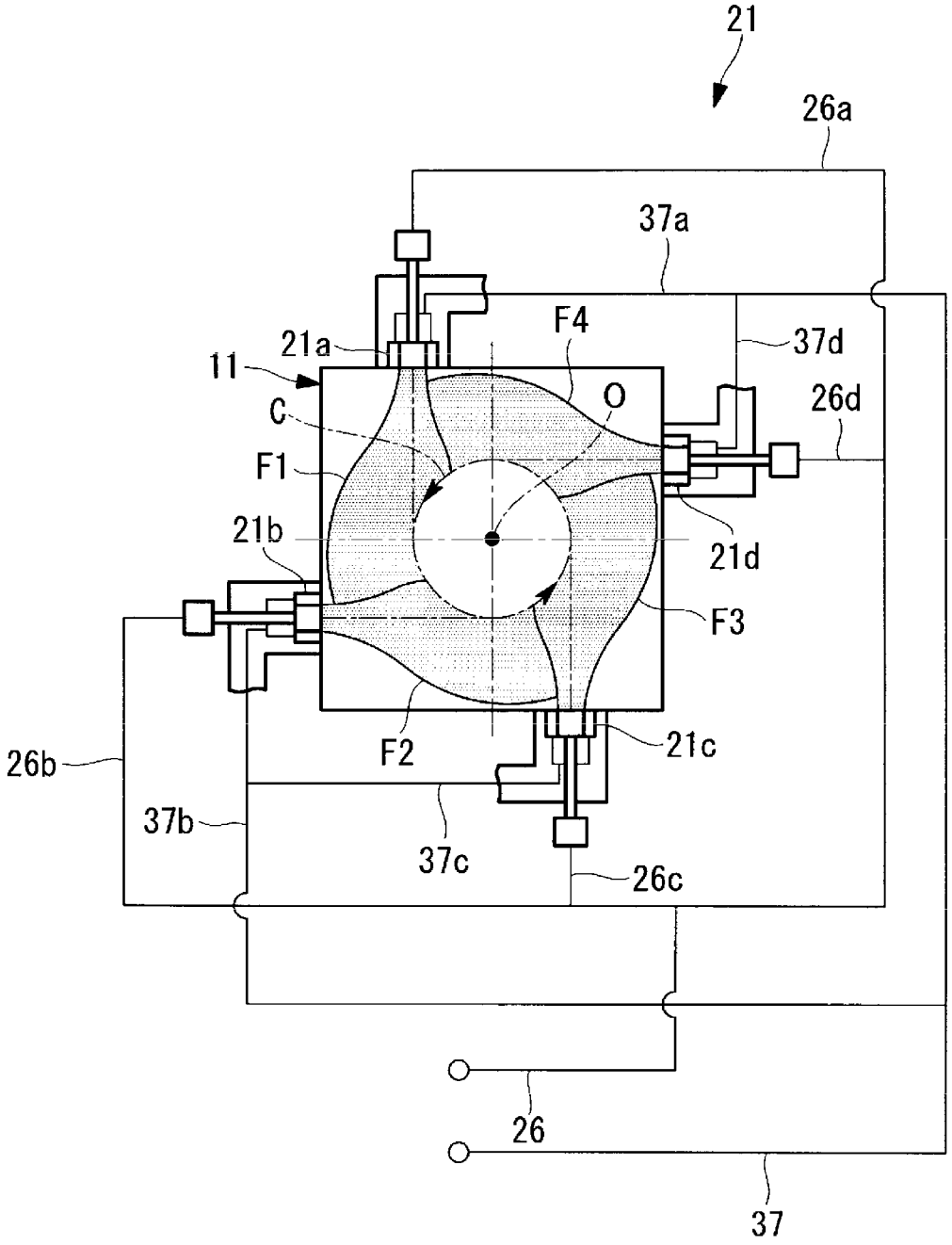
FIG. 4 is a plan view illustrating the arrangement configuration of the combustion burner.

FIG. 3 is a schematic configuration diagram illustrating a coal-fired boiler according to a first embodiment, and FIG. 4 is a plan view illustrating the arrangement configuration of a combustion burner.

The boiler in the first embodiment is a pulverized coal-fired boiler that uses pulverized coal obtained by pulverizing coal as a pulverized fuel (solid fuel), combusts the pulverized coal with combustion burners, and can collect heat produced by the combustion.

As illustrated in FIG. 3, the coal-fired boiler 10 in the first embodiment is a conventional boiler and includes a furnace 11, a combustion device 12, and a flue 13. The furnace 11 is shaped like a hollow square tube and is installed in the vertical direction. A furnace wall of the furnace 11 is constituted by a heat transfer pipe.

The combustion device 12 is disposed at a lower portion of the furnace wall (heat transfer pipe) of the furnace 11. The combustion device 12 includes a plurality of combustion burners 21, 22, 23, 24, 25 mounted on the furnace wall. In the present embodiment, each of the combustion burners 21, 22, 23, 24, 25 is constituted by a set of four combustion burners that are disposed at equal intervals in the circumferential direction, and five sets, that is, five rows are arranged in the vertical direction. However, the shape of the furnace, the number of the combustion burners in one row, and the number of the rows are not limited by this embodiment.

The combustion burners 21, 22, 23, 24, 25 are respectively connected with pulverizers (coal pulverizers/mills) 31, 32, 33, 34, 35 through pulverized coal supply tubes 26, 27, 28, 29, 30. The pulverizers 31, 32, 33, 34, 35 each have a configuration in which a mill table having a rotating shaft center extending in the vertical direction is supported in a housing so as to be driven to rotate, and a plurality of mill rollers are supported above the mill table so as to rotate in synchronization with rotation of the mill table, which is not illustrated in the drawings. Thus, coal fed between the pulverizing rollers and the mill table is pulverized to predetermined size in the pulverizers. The pulverized coal is classified using conveyance air (primary air) and is then supplied through the pulverized coal supply tubes 26, 27 28, 29, 30 to the first combustion burners 21, 22, 23, 24, 25.

The furnace 11 is provided with a wind box 36 in the mounting position of the combustion burners 21, 22, 23, 24, 25. The wind box 36 is connected with a first end portion of an air duct 37. A blower 38 is mounted at a second end portion of the air duct 37. The furnace 11 is further provided with an additional air supplier (hereinafter, referred to as an additional air nozzle) 39 above the mounting position of the combustion burners 21, 22, 23, 24, 25. The additional air nozzle 39 is connected with an end portion of a branching air duct 40 branching off from the air duct 37. Thus, combustion air (fuel gas combustion air/secondary air) sent from the blower 38 is supplied through the air duct 37 to the wind box 36 and is then supplied from the wind box 36 to the combustion burners 21, 22, 23, 24, 25, and combustion air (additional air) sent from the blower 38 is supplied through the branching air duct 40 to the additional air nozzle 39.

The flue 13 is connected with an upper portion of the furnace 11. The flue 13 is provided with superheaters 51, 52, 53, reheaters 54, 55, and fuel economizers 56, 57 for collecting heat of flue gas, and heat is exchanged between the flue gas produced by combustion in the furnace 11 and water.

The flue 13 is connected, on the downstream side, with a gas duct 58 through which the flue gas after heat exchange is released. An air heater 59 is disposed between the gas duct 58 and the air duct 37, and heat is exchanged between the air flowing in the air duct 37 and the flue gas flowing in the gas duct 58, thereby increasing the temperature of the combustion air supplied to the combustion burners 21, 22, 23, 24, 25.

The gas duct 58 is provided with a denitrification device, an electrostatic precipitator, an induced blower, and a desulfurization device, and is further provided with a funnel at a downstream end portion, which is not illustrated in the drawings.

The combustion device 12 will now be described in detail. The combustion burners 21, 22, 23, 24, 25 constituting the combustion device 12 have substantially the same configuration, and thus the combustion burner 21 will be described as an example of the combustion burners.

As illustrated in FIG. 4, the combustion burner 21 is constituted by combustion burners 21*a*, 21*b*, 21*c*, 21*d* that are respectively disposed on four walls of the furnace 11. The combustion burners 21*a*, 21*b*, 21*c*, 21*d* are respectively connected with branching tubes 26*a*, 26*b*, 26*c*, 26*d* branching off from the pulverized coal supply tube 26 and with branching tubes 37*a*, 37*b*, 37*c*, 37*d* branching off from the air duct 37.

Thus, the combustion burners 21*a*, 21*b*, 21*c*, 21*d* inject a pulverized coal fuel-air mixture (fuel gas) of the pulverized coal and the conveyance air into the furnace 11 and inject the combustion air (fuel gas combustion air/secondary air) to the outer side of the pulverized coal fuel-air mixture. The pulverized coal fuel-air mixture is ignited to form four flames F1, F2, F3, F4. The flames F1, F2, F3, F4 form a swirling flame flow C swirling counterclockwise when viewed from above the furnace 11 (in FIG. 4).

As illustrated in FIGS. 3 and 4, in the coal-fired boiler 10 having this configuration, when the coal pulverizers 31, 32, 33, 34, 35 are activated, the solid fuel is pulverized, and the pulverized coal is supplied through the pulverized coal supply tubes 26, 27, 28, 29, 30 to the combustion burners 21, 22, 23, 24, 25, together with the conveyance air. The heated combustion air is supplied from the air duct 37 through the wind box 36 to the combustion burners 21, 22, 23, 24, 25 and from the branching air duct 40 to the additional air nozzle 39. Then, the combustion burners 21, 22, 23, 24, 25 inject the pulverized coal fuel-air mixture of the pulverized coal and the conveyance air into the furnace 11 and inject the combustion air into the furnace 11. At this time, ignition occurs to form flames. The additional air nozzle 39 injects the additional air into the furnace 11 to control combustion. In the furnace 11, the pulverized coal fuel-air mixture and the combustion air combust to generate flames. When flames are generated in a lower portion of the furnace 11, the combustion gas (flue gas) ascends in the furnace 11 and is released to the flue 13.

That is, the combustion burners 21, 22, 23, 24, 25 inject the pulverized coal fuel-air mixture and the combustion air (part of the secondary air) into a combustion region A of the furnace 11. At this time, ignition occurs to form the swirling flame flow C in the combustion region A. The swirling flame flow C ascends to a reduction region B while swirling. The additional air nozzle 39 injects the additional air above the reduction region B of the furnace 11. In the furnace 11, the amount of air supplied is set to be less than a theoretical amount of air with respect to the amount of pulverized coal supplied, so that a reducing atmosphere is maintained inside. After NOx produced by combustion of the pulverized coal is reduced in the furnace 11, the additional air is supplied to complete oxidative combustion of the pulverized coal, thereby reducing NOx emission due to combustion of the pulverized coal.

Water supplied from a feed water pump (not illustrated) is preheated by the fuel economizers 56, 57, then heated to saturated steam while being supplied to a steam drum (not illustrated) and to water tubes (not illustrated) in the furnace wall, and fed to the steam drum (not illustrated). The saturated steam in the steam drum (not illustrated) is introduced into the superheaters 51, 52, 53 and superheated with the combustion gas. The superheated steam generated by the superheaters 51, 52, 53 is supplied to a power generating plant (for example, a turbine) (not illustrated). The steam extracted in the middle of an expansion process of the turbine is introduced into the reheaters 54, 55, superheated again, and returned to the turbine. The furnace 11 in the above description is of a drum type (a steam drum) but is not limited to this configuration.

Then, after the flue gas passes through the fuel economizers 56, 57 of the flue 13, the denitrification device, electrostatic precipitator, and desulfurization device (not illustrated) respectively remove a toxic substance such as NOx with a catalyst, particulate matter, and sulfur from the flue gas in the gas duct 58. The flue gas is then released through the funnel to the atmosphere.

Figure 1:
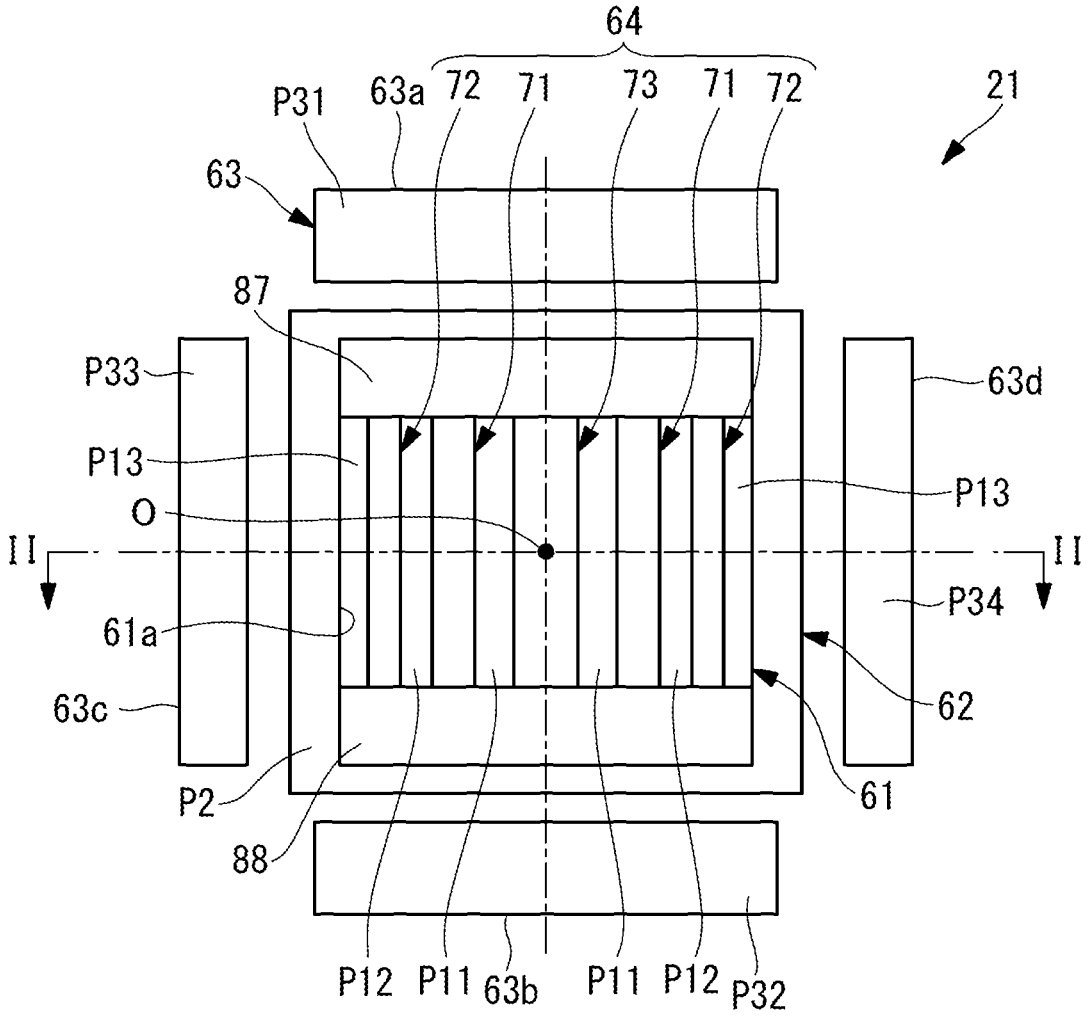
FIG. 1 is a front view of a combustion burner according to a first embodiment.

The combustion burner 21 (21*a*, 21*b*, 21*c*, 21*d*) having this configuration will now be described in detail. FIG. 1 is a front view of the combustion burner according to the first embodiment, and FIG. 2 is a horizontal cross-sectional view (cross-sectional view taken along the line II-II in FIG. 1) of the combustion burner.

Figure 2:
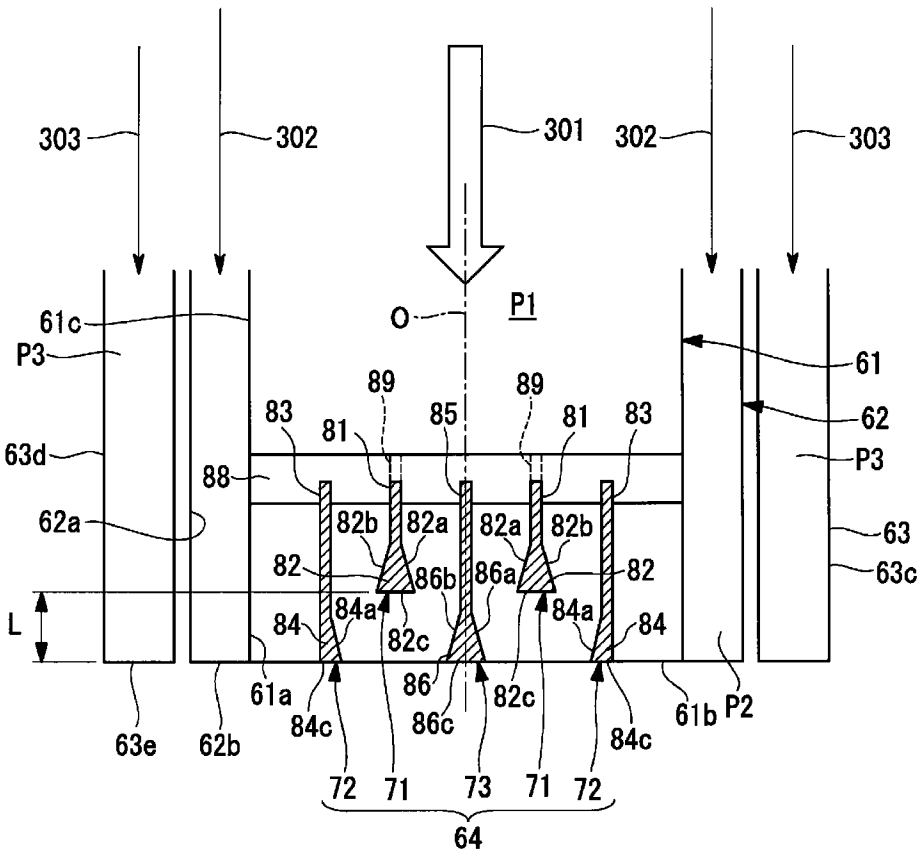
FIG. 2 is a horizontal cross-sectional view (cross-sectional view taken along the line II-II in FIG. 1) of the combustion burner.

As illustrated in FIGS. 1 and 2, the combustion burner 21 is provided with a fuel nozzle 61, a combustion air nozzle 62, and a secondary air nozzle 63 in this order from the center, and provided with an inside member 64 inside the fuel nozzle 61.

The fuel nozzle 61 can eject the pulverized fuel-air mixture (hereinafter, referred to as fuel gas) 301 of the pulverized coal (solid fuel) and the conveyance air (primary air). The combustion air nozzle 62 is disposed at the outer side the fuel nozzle 61 and can eject part of combustion air (fuel gas combustion air) 302 to the outer peripheral side of the fuel gas 301 ejected from the fuel nozzle 61. The secondary air nozzle 63 is disposed at the outer side the combustion air nozzle 62 and can eject part of the combustion air (hereinafter, referred to as secondary air) 303 to the outer peripheral side of the fuel gas combustion air 302 ejected from the combustion air nozzle 62.

The inside member 64 is disposed in the fuel nozzle 61 and at a distal end of the fuel nozzle 61, that is, downstream in the flow direction of the fuel gas 301, and functions as a member for igniting the fuel gas 301 and stabilizing flames or guiding the fuel. The inside member 64 is constituted by two first members 71, two second members 72, and a third member 73. The first members 71, second members 72, and third member 73 are oriented in the vertical direction and arranged at predetermined intervals in the horizontal direction. Here, the vertical direction includes a direction having a very small angle with respect to the vertical direction.

The first members 71 are disposed at the distal end of the fuel nozzle 61 on both radial sides (the sides close to inner wall surfaces 61*a* of the fuel nozzle 61) of the axial line (the center line of the fuel nozzle 61) O extending in the ejected direction of the fuel gas 301, at predetermined intervals (gaps) from the inner wall surfaces 61*a* of the fuel nozzle 61. The first members 71 are each shaped like a plate extending in the vertical direction and the ejected direction of the fuel gas 301. The second members 72 are disposed at the distal end of the fuel nozzle 61 at predetermined intervals (gaps) on both horizontally outer sides (the sides close to the inner wall surfaces 61*a* of the fuel nozzle 61) of the respective first members 71 and at predetermined intervals (gaps) from the inner wall surfaces 61*a* of the fuel nozzle 61. The second members 72 are each shaped like a plate extending in the vertical direction and the ejected direction of the fuel gas 301. The third member 73 is disposed at the distal end of the fuel nozzle 61 on the axial line (the center line of the fuel nozzle 61) O extending in the ejected direction of the fuel gas 301, at predetermined intervals (gaps) from the first members 71. The third member 73 is shaped like a plate extending in the vertical direction and the ejected direction of the fuel gas 301.

The fuel nozzle 61 and combustion air nozzle 62 each have a long tubular structure. The fuel nozzle 61 defines a fuel gas flow path P1 with four flat inner wall surfaces 61*a*. The fuel gas flow path P1 extends in the longitudinal direction and has an identical flow path cross section. The fuel nozzle 61 is provided with a rectangular opening 61*b* at the distal end (downstream end). The combustion air nozzle 62 defines a combustion air flow path P2 with four flat outer wall surfaces 61*c* of the fuel nozzle 61 and four flat inner wall surfaces 62*a*. The combustion air flow path P2 extends in the longitudinal direction and has an identical flow path cross section. The combustion air nozzle 62 is provided with a rectangular ring shaped opening 62*b* at the distal end (downstream end). This configuration allows the fuel nozzle 61 and combustion air nozzle 62 to form a double-tubular structure.

The secondary air nozzle 63 has a long tubular structure disposed at the outer side the fuel nozzle 61 and combustion air nozzle 62. The secondary air nozzle 63 has a tubular structure having four rectangular cross sections and is constituted by secondary air nozzle main bodies 63*a*, 63*b*, 63*c*, 63*d* that are independently disposed above, below, at the left of, and at the right of the combustion air nozzle 62 at predetermined gaps on the outer side the combustion air nozzle 62. The secondary air nozzle 63 defines four secondary air flow paths P31, P32, P33, P34 with the four secondary air nozzle main bodies 63*a*, 63*b*, 63*c*, 63*d*. The secondary air flow paths P31, P32, P33, P34 extend in the longitudinal direction and have an identical flow path cross section. The secondary air nozzle 63 is provided with a rectangular ring shaped opening 63*e* at the distal end (downstream end).

The fuel nozzle 61 and combustion air nozzle 62 may have a rectangular shape instead of a regular square shape. In this case, the corners may be curved. A tubular structure with curved corners can improve the strength of the nozzle. Alternatively, the shape may be cylindrical.

Thus, the opening 62*b* of the combustion air nozzle 62 (combustion air flow path P2) is disposed at the outer side the opening 61*b* of the fuel nozzle 61 (fuel gas flow path P1). The opening 63*e* of the secondary air nozzle 63 (secondary air flow path P3) is disposed at the outer side the opening 62*b* of the combustion air nozzle 62 (combustion air flow path P2) at predetermined intervals. The openings 61*b*, 62*b*, 63*e* of the fuel nozzle 61, combustion air nozzle 62, and secondary air nozzle 63 are arranged in the same position in the flow direction of the fuel gas 301 and air so as to be aligned on the same plane.

The secondary air nozzle 63 may have a double rectangular tubular structure disposed at the outer side the combustion air nozzle 62 instead of being constituted by the four secondary air nozzle main bodies 63*a*, 63*b*, 63*c*, 63*d*. The secondary air nozzle 63 may be constituted by only upper and lower secondary air nozzle main bodies 63*a*, 63*b* or only left and right secondary air nozzle main bodies 63*c*, 63*d* instead of the secondary air nozzle main bodies 63*a*, 63*b*, 63*c*, 63*d*. Furthermore, each of the secondary air nozzle main bodies 63*a*, 63*b*, 63*c*, 63*d* of the secondary air nozzle 63 may be provided with a damper opening adjustment mechanism to adjust the amount of the secondary air 303 ejected.

The first members 71 are each constituted by a flat portion 81 having a constant width and a widened portion 82 integrally provided at the front end (downstream end in the flow direction of the fuel gas 301) of the flat portion 81, in a cross section in the horizontal direction (FIG. 2). The flat portion 81 has a constant width in the flow direction of the fuel gas 301. The widened portion 82 has a width becoming wider toward the flow direction of the fuel gas 301. The widened portion 82 has a horizontal cross section substantially shaped like an isosceles triangle, and has a base end connected with the flat portion 81, a distal end becoming wider toward the downstream side in the flow direction of the fuel gas 301, and a front end being a plane orthogonal to the flow direction of the fuel gas 301. That is, the widened portion 82 includes a first guide surface (first inclined surface) 82*a* inclined inward in the width direction (toward the center line O of the fuel nozzle 61), a second guide surface (first inclined surface) 82*b* inclined outward in the width direction (toward the inner wall surface 61*a* of the fuel nozzle 61), and an end surface 82*c* disposed on the front end side. The corner formed by the first guide surface 82*a* and end surface 82*c* and the corner formed by the second guide surface 82*b* and end surface 82*c* are inclination end edges (first inclination end edges) where the inclination of the inclined guide surfaces 82*a*, 82*b* ends. The fuel gas flow is separated at these inclination end edges being corners.

The widened portion 82 has a constant width in its longitudinal direction (vertical direction) but may have varied widths. The first guide surface 82*a*, second guide surface 82*b*, and end surface 82*c* are desirably planes but may be bent or curved in a concave or convex manner. The widened portion 82 has a horizontal cross section substantially shaped like an isosceles triangle. However, no such limitation is intended, and the horizontal cross section may have a shape in which the end surface 82*c* is concave or a Y shape.

The second members 72 are each constituted by a flat portion 83 having a constant width and a widened portion 84 integrally provided at the front end (downstream end in the flow direction of the fuel gas 301) of the flat portion 83, in a cross section cut in the horizontal direction (FIG. 2). The flat portion 83 has a constant width in the flow direction of the fuel gas 301. The widened portion 84 has a width becoming wider toward the flow direction of the fuel gas 301. The widened portion 84 has a horizontal cross section substantially shaped like a right triangle, and has a base end connected with the flat portion 83, a distal end becoming wider toward the downstream side in the flow direction of the fuel gas 301, and a front end being a plane orthogonal to the flow direction of the fuel gas 301. That is, the widened portion 84 includes a first guide surface (second inclined surface) 84*a* inclined inward in the width direction (toward the center line O of the fuel nozzle 61) and an end surface 84*c* disposed on the front end side, and does not have a guide surface on the outer side in the width direction (on the inner wall surface 61*a* side of the fuel nozzle 61) and instead has a plane continuing from an end surface of the flat portion 83. The corner formed by the first guide surface 84*a* and end surface 84*c* is an inclination end edge (second inclination end edge) where the inclination of the inclined guide surface 84*a* ends. The fuel gas flow is separated at this inclination end edge being a corner.

The widened portion 84 has a constant width in its longitudinal direction (vertical direction) but may have varied widths. A smaller widened portion 84 can relatively intensify inside ignition. The first guide surface 84*a* and end surface 84*c* are desirably planar but may be bent or curved in a concave or convex manner. The widened portion 84 has a horizontal cross section substantially shaped like a right triangle. However, no such limitation is intended, and the horizontal cross section may have a shape in which the end surface 84*c* is concave or in which a planar object is bent.

The third member 73 is constituted by a flat portion 85 having a constant width and a widened portion 86 integrally provided at the front end (downstream end in the flow direction of the fuel gas 301) of the flat portion 85, in a cross section in the horizontal direction (FIG. 2). The flat portion 85 has a constant width in the flow direction of the fuel gas 301. The widened portion 86 has a width becoming wider toward the flow direction of the fuel gas 301. The widened portion 86 has a horizontal cross section substantially shaped like an isosceles triangle, and has a base end connected with the flat portion 85, a distal end becoming wider toward the downstream side in the flow direction of the fuel gas 301, and a front end being a plane orthogonal to the flow direction of the fuel gas 301. That is, the widened portion 86 includes a first guide surface (third inclined surface) 86*a* inclined toward one of the first members 71, a second guide surface (third inclined surface) 86*b* inclined toward the other first member 71, and an end surface 86*c* disposed on the front end side. The corner formed by the first guide surface 86*a* and end surface 86*c* and the corner formed by the second guide surface 86*b* and end surface 86*c* are inclination end edges (third inclination end edges) where the inclination of the inclined guide surfaces 86*a*, 86*b* ends. The fuel gas flow is separated at these inclination end edges being corners.

The widened portion 86 has a constant width in the longitudinal direction thereof (vertical direction) but may have varied widths. The first guide surface 86*a*, second guide surface 86*b*, and end surface 86*c* are desirably planes but may be bent or curved in a concave or convex manner. The widened portion 86 has a horizontal cross section substantially shaped like an isosceles triangle. However, no such limitation is intended, and the horizontal cross section may have a shape in which the end surface 86*c* is concave or a Y shape.

Here, the gaps having predetermined intervals are defined between the first members 71, the second members 72, the third member 73, and the inner wall surfaces of the fuel nozzle 61 as described above. These predetermined intervals are greater than at least the widths of the widened portions 82, 84, 86 of the members 71, 72, 73 or does not to cause at least the widened portions 82, 84, 86 of the members 71, 72, 73 to interfere (come into contact) with each other or with the inner wall surfaces 61*a* of the fuel nozzle 61 in the event of thermal elongation.

The fuel nozzle 61 includes, as the inside member 64 thereof, the first, second, and third members 71, 72, 73, disposed inside at predetermined intervals in the width direction (horizontal direction). The second and third members 72, 73 are respectively provided with the widened portions 84, 86 at the distal ends. The widened portions 84, 86 respectively have the end surfaces 84*c*, 86*c* arranged in the same position as the opening 61*b* of the fuel nozzle 61 in the flow direction of the fuel gas 301 so as to be aligned on the same plane. The first members 71 are provided with the widened portions 82 at the distal ends. The widened portions 82 have the end surfaces 82*c* arranged upstream of the opening 61*b* of the fuel nozzle 61 in the ejected direction of the fuel gas 301. That is, the end surfaces 84*c*, 86*c* of the widened portions 84, 86 of the second and third members 72, 73 are in the same position as the opening 61*b* of the fuel nozzle 61 in the ejected direction of the fuel gas 301. The end surfaces 82*c* of the widened portions 82 of the first members 71 are arranged in a position remote from the opening 61*b* of the fuel nozzle 61 (the end surfaces 84*c*, 86*c* of the widened portions 84, 86) toward the upstream side in the ejected direction of the fuel gas 301 by a predetermined distance L.

Here, the predetermined distance L is 0.001 D or greater and 1.0 D or less, preferably 0.03 D or greater and 0.5 D or less, and more preferably 0.05 D or greater and 0.3 D or less, where D is an equivalent diameter of the opening of the fuel nozzle 61.

The above-described lower and upper limits are determined from following viewpoints. If the predetermined distance is below the lower limit, the distance between the first members 71, the second members 72 and third member 73 is too short, thus an advantage in that the cross-sectional area of the flow path is ensured by shifting the members in position is not obtained. If the predetermined distance is above the upper limit, a recirculation region formed with the first members 71 disappears before the second members 72 and third member 73, thus an advantage in that the fuel (pulverized coal) is guided from the second members 72 and third member 73 to the recirculation region at the first members 71 is not obtained.

The upper ends and lower ends of the rear portions of the first, second, and third members 71, 72, 73 are supported by the inner wall surfaces 61*a* of the fuel nozzle 61 through support members 87, 88. The support members 87, 88 are fixed to the upper portions and lower portions of the inner wall surfaces 61*a* of the fuel nozzle 61 and support the upper ends and lower ends of the first, second, and third members 71, 72, 73.

Here, the first, second, and third members 71, 72, 73 are fixed to the support members 87, 88 fixed to the inner wall surfaces 61*a* of the fuel nozzle 61. However, the present invention is not limited to this configuration. For example, the end surfaces 82*c* of the widened portions 82 of the first members 71 are retracted from the opening 61*b* of the fuel nozzle 61 by the predetermined distance L. The predetermined distance L for determining the position of the widened portions 82 may be changed depending on the type and amount of fuel ejected. Thus, the first members 71 are desirably provided so that the positions thereof are adjustable in the ejected direction of the fuel gas 301. As a specific configuration, for example, guide rails 89 extending in the ejected direction of the fuel gas 301 may be fixed in the support members 87, 88 at the inner wall surfaces 61*a* of the fuel nozzle 61 and support the first members 71 (flat portions 81) movably. In this case, the first members 71 may be moved for adjustment with respect to the guide rails 89 and then locked with jigs such as bolts. Furthermore, a drive device (such as a hydraulic cylinder and a motor) may be provided to move the first members 71 with respect to the guide rails 89 for adjustment.

In the fuel nozzle 61, the first, second, and third members 71, 72, 73 as the inside member 64 are supported by the support members 87, 88. Thus, the fuel gas flow path P1 is divided into six regions. That is, the fuel gas flow path P1 is divided into first fuel gas flow paths P11 between the third member 73 and the first members 71, second fuel gas flow paths P12 between the first members 71 and the second members 72, and third fuel gas flow paths P13 between the second members 72 and the inner wall surfaces 61*a* of the fuel nozzle 61.

Note that the support members 87, 88, which support the members 71, 72, 73, have no influence on the flow of the fuel gas 301 and have the smallest possible width (thinnest possible thickness) smaller than that of the members 71, 72, 73 (flat portions 81, 83, 85, widened portions 82, 84, 86). The support members 87, 88 support the flat portions 81, 83, 85 of the members 71, 72, 73 in the present embodiment but may support the widened portions 82, 84, 86 or both the flat portions 81, 83, 85 and the widened portions 82, 84, 86. The positions in which the support members 87, 88 support the members 71, 72, 73 in the circumferential direction are not limited by the embodiment.

In the combustion burners 21 having this configuration, the fuel gas (pulverized coal and primary air) 301 flows in the fuel gas flow path P1 of the fuel nozzle 61 and is ejected through the opening 61*b* to the furnace 11 (see FIG. 3). The fuel gas combustion air 302 flows in the combustion air flow path P2 of the combustion air nozzle 62 and is ejected through the opening 62*b* to the outer side of the fuel gas 301. The secondary air 303 flows in the secondary air flow path P3 of the secondary air nozzle 63 and is ejected through the opening 63*e* to the outer side of the combustion air for the fuel gas 301. At this time, the fuel gas (pulverized coal and primary air) 301, fuel gas combustion air 302, and secondary air 303 are ejected as straight advancing flows in the burner axial line direction (along the center line O) without swirling.

Here, the fuel gas 301 flows while branching off by the first members 71, second members 72, and third member 73 at the opening 61*b* of the fuel nozzle 61, and ignites and combusts in this position to be combustion gas. The fuel gas combustion air 302 ejected around the outer periphery of the fuel gas 301 promotes combustion of the fuel gas 301. Furthermore, the secondary air 303 ejected around the outer peripheries of the combustion flames adjusts the proportion of the fuel gas combustion air 302 and the secondary air 303, enabling optimal combustion.

Each of the widened portions 82, 84, 86 of the first members 71, second members 72, and third member 73 constituting the inside member 64 has a splitting shape, so that the fuel gas 301 flows along the guide surfaces 82*a*, 82*b*, 84*a*, 86*a*, 86*b* of the widened portions 82, 84, 86 and then turns to the end surface 82*c*, 84*c*, 86*c* sides, thereby forming a recirculation region in front of the end surfaces 82*c*, 84*c*, 86*c*. Thus, ignition of the fuel gas 301 and flame stabilizing are performed in this recirculation region, achieving inside flame stabilizing of the combustion flames (flame stabilizing in the center region on the center line O side in the fuel nozzle 61). The outer peripheral portions of the combustion flames then have low temperatures, and the secondary air 303 can reduce the temperatures of the combustion flames under a high-oxygen atmosphere, resulting in a reduction in NOx emission at the outer peripheral portions of the combustion flames.

The widened portions 82 of the first members 71 are positioned upstream of the widened portions 84, 86 of the second and third members 72, 73 in the ejected direction of the fuel gas 301. This configuration shifts the position of narrowing the fuel gas flow path P1 of the fuel nozzle 61 in the ejected direction of the fuel gas 301, reduces a region where the flow path narrows significantly, and reduces the flow rate of the fuel gas 301 in the positions of the widened portions 82, 84, 86. Thus, inside ignition and inside flame stabilizing can be enhanced without increasing the size of the fuel nozzle 61.

The fuel gas 301 forms a recirculation region with the guide surfaces 82*a*, 82*b* of the widened portions 82 of the first members 71, first. This recirculation region is formed in the fuel nozzle 61 and is thus difficult to receive radiant heat from an adjacent flame in the furnace, resulting in favorable inside ignition and inside flame stabilizing, efficient consumption of air from the inside of the fuel nozzle 61, and prevention of outside ignition. Next, after the recirculation region is formed with the guide surfaces 82*a*, 82*b* of the widened portions 82 of the first members 71, the fuel gas 301 forms a recirculation region with the guide surfaces 84*a*, 86*a*, 86*b* of the widened portions 84, 86 of the second members 72 and third member 73. Since the widened portions 82, 84, 86 of the members 71, 72, 73 are in different positions in the fuel gas flow direction, the flow rate of the fuel gas 301 can be reduced at the widened portions 82, 84, 86 of the members 71, 72, 73 in comparison with the configuration in which the widened portions of the members are in the same position in the fuel gas flow direction. In addition, the pulverized coal guided by the guide surface 82*a*, 82*b* flows toward the end surfaces 84*c*, 86*c* on the downstream side, and the amount of the pulverized coal is thus increased. This can also enhance inside ignition and inside flame stabilizing. Here, the first members 71 function not only as flame stabilizers but also as guide members guiding the pulverized coal toward the second members 72 and third member 73 on the downstream side.

The widened portions 84 of the second members 72 have the guide surfaces 84*a* only on the first member 71 sides and the flat shapes on the inner wall surface 61*a* sides of the fuel nozzle 61. This configuration does not allow a recirculation region to be formed in the third fuel gas flow paths P13, which do not have a flame stabilizing function, between the inner wall surfaces 61*a* of the fuel nozzle 61 and the second members 72, resulting in prevention of outside ignition.

The secondary air nozzle 63 ejects the secondary air 303 so as to surround the fuel nozzle 61 not only from above and below but also from the left and right, that is, over the entire periphery. It is thus difficult to form a high-temperature high-oxygen region partially in the circumferential direction, and the oxygen level is uniformized in the circumferential direction, resulting in a reduction in NOx emission at the outer peripheral portions of the combustion flames.

The combustion burner in the first embodiment is provided with the fuel nozzle 61 ejecting the fuel gas 301 that is a mixture of the pulverized coal and air, the combustion air nozzle 62 ejecting air from the outer side of the fuel nozzle 61, and the inside member 64 functioning as a flame stabilizing section or a guide member spreading the ejected direction of the fuel gas 301, and is provided with the first members 71 disposed upstream of the opening 61*b* of the fuel nozzle 61 in the ejected direction of the fuel gas 301, and the second members 72 disposed downstream of the first member 71 in the ejected direction of the fuel gas 301 and on both sides of the first members 71 in the widened direction.

Thus, the fuel gas 301 flowing in the fuel nozzle 61 can maintain combustion with the recirculation regions formed downstream of the members 71, 72. Here, since the first members 71 and second members 72 are shifted in position in the ejected direction of the fuel gas 301, the flow rate is reduced at the opening 61*b* of the fuel nozzle 61, resulting in an improvement in flame stability without increasing the size of the fuel nozzle 61. The fuel gas 301 supplied from the second members 72 to the recirculation region formed with the first members 71 can improve flame stability. Ignition of the fuel gas 301 and flame stabilizing are performed at the first members 71 and second members 72 in this order, and ignition occurs relatively from the center portion of the cross section of the fuel gas flow. Thus, the pulverized coal can be efficiently collected to thereby enhance inside flame stabilizing. Accordingly, inside flame stabilizing performance can be improved.

In the combustion burner in the first embodiment, the guide surfaces 82*a*, 82*b* of the widened portions 82 of the first members 71 are provided on the axial line center O sides in the fuel nozzle 61 and the inner wall surface 61*a* sides of the fuel nozzle 61, and the guide surfaces 84*a* of the widened portions 84 of the second members 72 are provided only on the axial line center O sides in the fuel nozzle 61. This configuration allows the fuel gas 301 to be widened on both sides by the guide surfaces 82*a*, 82*b* of the first members 71 and to form the recirculation region, and to be widened only on the first member 71 sides by the guide surfaces 84*a* of the second members 72 and to form the recirculation region, resulting in prevention of outside flame stabilizing in the fuel nozzle 61 and a reduction in NOx emission.

The combustion burner in the first embodiment is provided with the first members 71 in plurality at predetermined intervals and the second members 72 at predetermined intervals on both sides toward the inner wall surfaces 61*a* of the fuel nozzle 61 with respect to the first members 71. The first members 71 and second members 72 are thus arranged efficiently so as to face each other, so that the recirculation regions can be appropriately formed.

In the combustion burner in the first embodiment, the third member 73 is disposed between the first members 71. The first members 71 positioned upstream in the ejected direction of the fuel gas 301 are thus disposed between the second members 72 and the third member 73 positioned at the opening 61*b* of the fuel nozzle 61, so that the members 71, 72, 73 are positioned alternately in the ejected direction of the fuel gas 301 in the fuel nozzle 61. This configuration increases combinations of the members 71, 72, 73 shifted in position in the ejected direction of the fuel gas 301 and thus reduces the flow rate of the ejection. Supply of the pulverized coal from the third member 73 to the recirculation region formed with the first members 71 can improve inside flame stabilizing performance. Here, the third member 73 also functions as a guide member guiding the pulverized coal toward the first members 71.

In the combustion burner in the first embodiment, the first members 71 are provided so that the positions thereof are adjustable in the ejected direction of the fuel gas 301. Thus, for example, if the type of pulverized coal is changed, changing the positions of the first members 71 toward the upstream or downstream side in the ejected direction of the fuel gas 301 depending on the type of pulverized coal ensures favorable inside flame stabilizing performance. That is, it is desirable that when pulverized coal (coal) that is difficult to combust is used, the first members 71 are adjusted by being moved upstream in the ejected direction of the fuel gas 301, and when pulverized coal (coal) that readily combusts is used, the first members 71 are adjusted by being moved downstream in the ejected direction of the fuel gas 301.

In the combustion burner in the first embodiment, the first members 71, second members 72, and third member 73 are oriented in the vertical direction and arranged at predetermined intervals in the horizontal direction. This configuration prevents the pulverized coal contained in the fuel gas 301 flowing in the fuel nozzle 61 from being accumulated on the members 71, 72, 73 and can thus prevent a decrease in flame stabilizing performance.

In the combustion burner in the first embodiment, the secondary air nozzle 63 is disposed above, below, at the left of, and at the right of the fuel nozzle 61. This configuration allows the secondary air to be ejected outward of the second members 72, which do not have a flame stabilizing function on the outer side. Thus, even if these regions have excess oxygen, air can be supplied to the outer peripheries of the flames without increasing NOx emission. When a coal fuel, such as pulverized coal, is used, an air shortage may produce hydrogen sulfide, resulting in corrosion of the furnace wall. However, the secondary air nozzle 63 can sufficiently supply air to the outer peripheries of the flames and thus prevent hydrogen sulfide from being produced.

The boiler in the first embodiment is provided with the furnace 11 that is hollow and installed in the vertical direction, the combustion burner 21 disposed in the furnace 11, and the flue 13 disposed at the upper portion of the furnace 11. This configuration allows the combustion burner 21 to improve inside flame stabilizing performance, resulting in an improvement in boiler efficiency. The combustion burner 21 in the present embodiment is described as a corner firing type in which the combustion burners 21 are disposed at corners of the furnace 11 but may be applied to an opposed firing type in which the combustion burners 21 are disposed in the furnace 11 so as to face each other.

The first members 71, second members 72, and third member 73 described in the present embodiment all function as flame stabilizers; however, each of the members may function as a guide member guiding the pulverized coal toward another member without functioning as a flame stabilizer. For example, when the pulverized coal is guided from the first members 71 toward the second members 72 and third member 73, the first members 71 function as guide members. In this case, the first members 71 may not function as flame stabilizers. When the pulverized coal is supplied from the second members 72 or third member 73 to the recirculation region at the first members 71, the second members 72 or third member 73 function as guide members. In this case, the second members 72 or third member 73 may not function as flame stabilizers.

Second Embodiment

Figure 5:
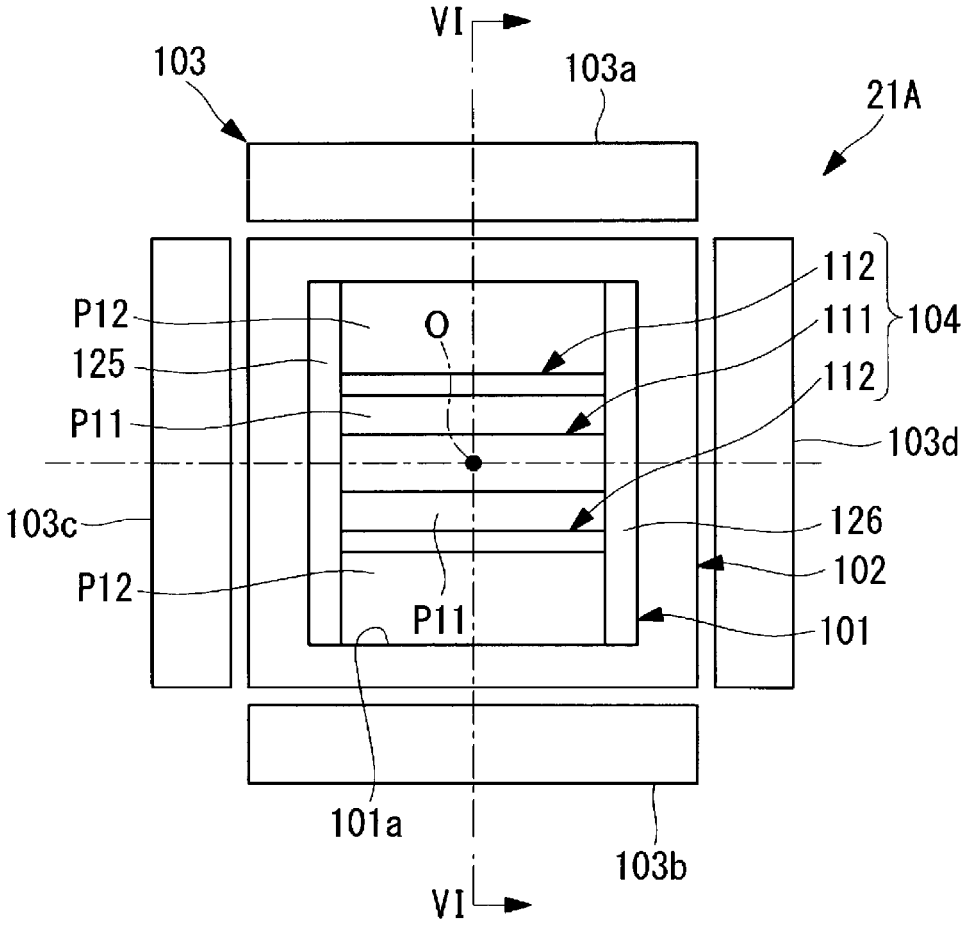
FIG. 5 is a front view of a combustion burner according to a second embodiment.
Figure 6:
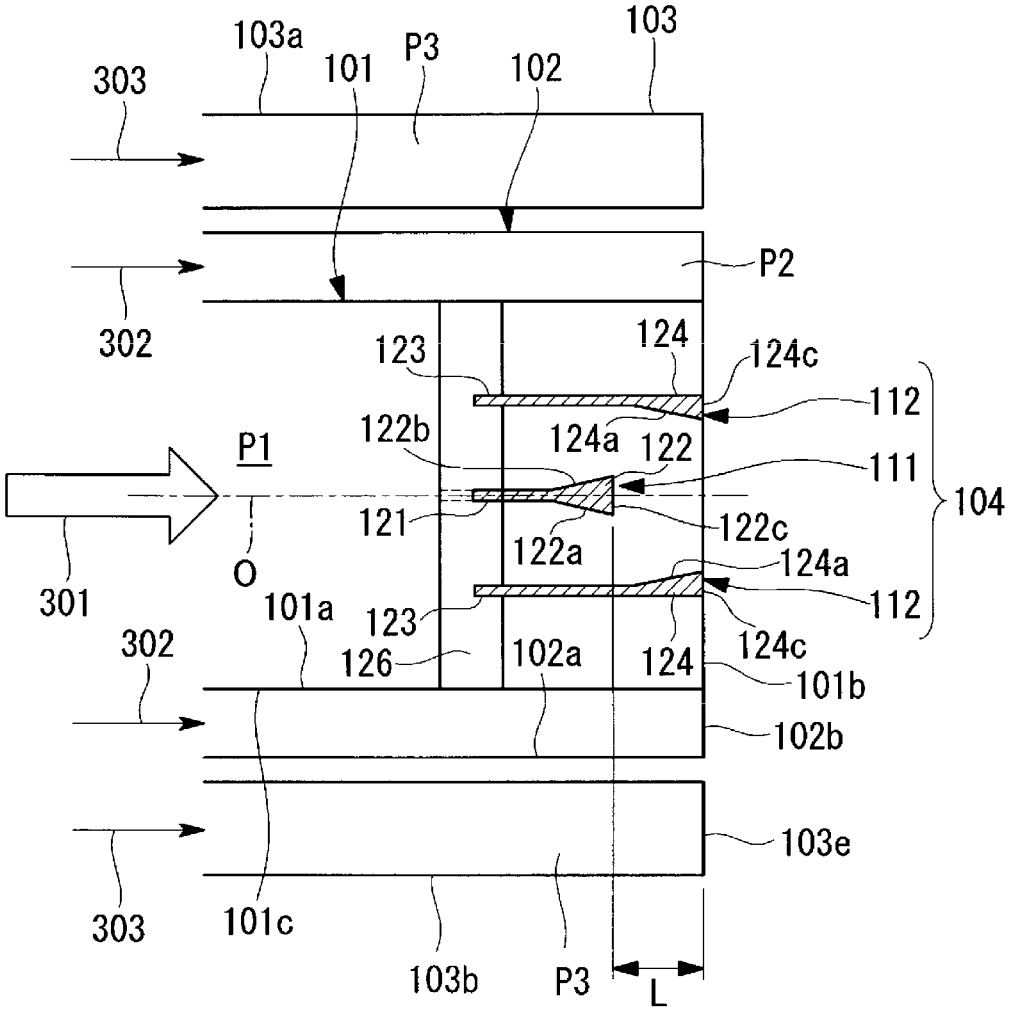
FIG. 6 is a horizontal cross-sectional view (cross-sectional view taken along the line VI-VI in FIG. 5) of the combustion burner.

FIG. 5 is a front view of a combustion burner according to a second embodiment, and FIG. 6 is a vertical cross-sectional view (cross-sectional view taken along the line VI-VI in FIG. 5) of the combustion burner.

As illustrated in FIGS. 5 and 6, the combustion burner 21A in the second embodiment is provided with a fuel nozzle 101, a combustion air nozzle 102, and a secondary air nozzle 103 in this order from the center, and provided with an inside member 104 inside the fuel nozzle 101.

The fuel nozzle 101 can eject a fuel gas that is a mixture of pulverized coal and primary air. The combustion air nozzle 102 is disposed at the outer side the fuel nozzle 101 and can eject fuel gas combustion air to the outer peripheral side of the fuel gas ejected from the fuel nozzle 101. The secondary air nozzle 103 is disposed at the outer side the combustion air nozzle 102 and can eject secondary air to the outer peripheral side of the fuel gas combustion air ejected from the combustion air nozzle 102.

The inside member 104 is disposed in the fuel nozzle 101 and at a distal end of the fuel nozzle 101, that is, downstream in the flow direction of the fuel gas, and functions as a member for igniting the fuel gas and stabilizing flames or guiding the fuel. The inside member 104 is constituted by a first member 111 and two second members 112. The first member 111 and second members 112 are oriented in the horizontal direction and arranged at predetermined intervals in the vertical direction. Here, the horizontal direction includes a direction having a very small angle with respect to the horizontal direction.

The first member 111 is disposed at the distal end of the fuel nozzle 101 on the axial line (the center line of the fuel nozzle 101) O extending in the ejected direction of the fuel gas, at predetermined intervals (gaps) from inner wall surfaces 101*a* of the fuel nozzle 101. The first member 111 is shaped like a plate extending in the horizontal direction and the ejected direction of the fuel gas. The second members 112 are disposed at the distal end of the fuel nozzle 101 at predetermined intervals (gaps) on both vertically outer sides (the sides close to the inner wall surfaces 101*a* of the fuel nozzle 101) of the first member 111 and at predetermined intervals (gaps) from the inner wall surfaces 101*a* of the fuel nozzle 101. The second members 112 are each shaped like a plate extending in the horizontal direction and the ejected direction of the fuel gas.

The fuel nozzle 101 and combustion air nozzle 102 each have a long tubular structure. The fuel nozzle 101 defines a fuel gas flow path P1 with four flat inner wall surfaces 101*a*. The fuel gas flow path P1 extends in the longitudinal direction and has an identical flow path cross section. The fuel nozzle 101 is provided with a rectangular opening 101*b* at the distal end (downstream end). The combustion air nozzle 102 defines a combustion air flow path P2 with four flat outer wall surfaces 101*c* of the fuel nozzle 101 and four flat inner wall surfaces 102*a*. The combustion air flow path P2 extends in the longitudinal direction and has an identical flow path cross section. The combustion air nozzle 102 is provided with a rectangular ring shaped opening 102*b* at the distal end (downstream end). This configuration allows the fuel nozzle 101 and combustion air nozzle 102 to form a double tubular structure.

The secondary air nozzle 103 has a long tubular structure disposed at the outer side the fuel nozzle 101 and combustion air nozzle 102. The secondary air nozzle 103 has a tubular structure having four rectangular cross sections and is constituted by secondary air nozzle main bodies 103*a*, 103*b*, 103*c*, 103*d* that are independently disposed above, below, at the left of, and at the right of the combustion air nozzle 102 at predetermined gaps on the outer side the combustion air nozzle 102. The secondary air nozzle 103 defines four secondary air flow paths P31, P32, P33, P34 with the four secondary air nozzle main bodies 103*a*, 103*b*, 103*c*, 103*d*. The secondary air flow paths P31, P32, P33, P34 extend in the longitudinal direction and have an identical flow path cross section. The secondary air nozzle 103 is provided with a rectangular ring shaped opening 103*e* at the distal end (downstream end).

Thus, the opening 102*b* of the combustion air nozzle 102 (combustion air flow path P2) is disposed at the outer side the opening 101*b* of the fuel nozzle 101 (fuel gas flow path P1), and the opening 103*e* of the secondary air nozzle 103 (secondary air flow path P3) is disposed at the outer side the opening 102*b* of the combustion air nozzle 102 (combustion air flow path P2) at predetermined intervals. The openings 101*b*, 102*b*, 103*e* of the fuel nozzle 101, combustion air nozzle 102, and secondary air nozzle 103 are arranged in the same position in the flow direction of the fuel gas and air so as to be aligned on the same plane.

The first member 111 is constituted by a flat portion 121 having a constant width and a widened portion 122 integrally provided at the front end (downstream end in the flow direction of the fuel gas) of the flat portion 121, in a cross section in the vertical direction (FIG. 6). The flat portion 121 has a constant width in the flow direction of the fuel gas. The widened portion 122 has a width becoming wider toward the flow direction of the fuel gas. The widened portion 122 has a horizontal cross section substantially shaped like an isosceles triangle, and has a base end connected with the flat portion 121, a distal end becoming wider toward the downstream side in the flow direction of the fuel gas, and a front end being a plane orthogonal to the flow direction of the fuel gas. That is, the widened portion 122 includes a first guide surface (first inclined surface) 122*a* inclined inward in the width direction (the height direction in FIG. 5) (toward the center line O of the fuel nozzle 101), a second guide surface (first inclined surface) 122*b* inclined outward in the width direction (the height direction in FIG. 5) (toward the inner wall surface 101*a* of the fuel nozzle 101), and an end surface 122*c* disposed on the front end side. The corner formed by the first guide surface 122*a* and end surface 122*c* and the corner formed by the second guide surface 122*b* and end surface 122*c* are inclination end edges (first inclination end edges) where the inclination of the inclined guide surfaces 122*a*, 122*b* ends. The fuel gas flow is separated at these inclination end edges being corners.

The widened portion 122 has a vertical cross section substantially shaped like an isosceles triangle. However, no such limitation is intended, and the vertical cross section may have a shape in which the end surface 122*c* is concave or a Y shape.

The second members 112 are each constituted by a flat portion 123 having a constant width and a widened portion 124 integrally provided at the front end (downstream end in the flow direction of the fuel gas) of the flat portion 123, in the cross section in the vertical direction (FIG. 6). The flat portion 123 has a constant width in the flow direction of the fuel gas. The widened portion 124 has a width becoming wider toward the flow direction of the fuel gas. The widened portion 124 has a horizontal cross section substantially shaped like a right triangle, and has a base end connected with the flat portion 123, a distal end becoming wider toward the downstream side in the flow direction of the fuel gas, and a front end being a plane orthogonal to the flow direction of the fuel gas. That is, the widened portion 124 includes a first guide surface (second inclined surface) 124*a* inclined inward in the width direction (toward the center line O of the fuel nozzle 101) and an end surface 124*c* disposed on the front end side, and does not have a guide surface on the outer side in the width direction (on the inner wall surface 101*a* side of the fuel nozzle 101) and instead has a plane continuing from an end surface of the flat portion 123. The corner formed with the first guide surface 124*a* and end surface 124*c* is an inclination end edge (second inclination end edge) where the inclination of the inclined guide surface 124*a* ends. The fuel gas flow is separated at this inclination end edge being a corner.

The widened portion 124 has a horizontal cross section substantially shaped like a right triangle. However, no such limitation is intended, and the horizontal cross section may have a shape in which the end surface 124*c* is concave or in which a planar object is bent.

The fuel nozzle 101 includes, as the inside member 104 thereof, the first and second members 111, 112 disposed inside at predetermined intervals in the height direction (vertical direction). The second members 112 are provided with the widened portions 124 at the distal ends. The widened portions 124 have the end surfaces 124*c* arranged in the same position as the opening 101*b* of the fuel nozzle 101 in the flow direction of the fuel gas so as to be aligned on the same plane. The first member 111 is provided with the widened portion 122 at the distal end. The widened portion 122 has the end surface 122*c* arranged upstream of the opening 101*b* of the fuel nozzle 101 in the ejected direction of the fuel gas. That is, the end surfaces 124*c* of the widened portions 124 of the second members 112 are in the same position as the opening 101*b* of the fuel nozzle 101 in the ejected direction of the fuel gas. The end surface 122*c* of the widened portion 122 of the first member 111 is arranged in a position remote from the opening 101*b* of the fuel nozzle 101 (the end surfaces 124*c* of the widened portions 124) toward the upstream side in the ejected direction of the fuel gas by a predetermined distance L.

Here, the predetermined distance L is 0.001 D or greater and 1.0 D or less, preferably 0.03 D or greater and 0.5 D or less, and more preferably 0.05 D or greater and 0.3 D or less, where D is an equivalent diameter of the opening of the fuel nozzle 101.

The above-described lower and upper limits are determined from the following viewpoints. If the predetermined distance is below the lower limit, the distance between the first member 111 and the second members 112 is too short, thus an advantage in that the cross-sectional area of the flow path is ensured by shifting the members in position is not obtained. If the predetermined distance is above the upper limit, a recirculation region formed with the first member 111 disappears before the second members 112, thus an advantage in that the fuel (pulverized coal) is guided from the second members 112 to the recirculation region at the first member 111 is not obtained.

The left and right ends of the rear portions of the first and second members 111, 112 are supported by the inner wall surfaces 101*a* of the fuel nozzle 101 through support members 125, 126. The support members 125, 126 are fixed to the left portions and right portions of the inner wall surfaces 101*a* of the fuel nozzle 101 and support the left ends and right ends of the first and second members 111, 112.

In the fuel nozzle 101, the first and second members 111, 112 as the inside member 104 are supported by the support members 125, 126. Thus, the fuel gas flow path P1 is divided into four regions. That is, the fuel gas flow path P1 is divided into first fuel gas flow paths P11 between the first member 111 and the second members 112 and second fuel gas flow paths P12 between the second members 112 and the inner wall surfaces 101*a* of the fuel nozzle 101.

In the combustion burners 21A having this configuration, the fuel gas flows in the fuel gas flow path P1 of the fuel nozzle 101 and is ejected through the opening 101*b* to the furnace 11 (see FIG. 3). The fuel gas combustion air flows in the combustion air flow path P2 of the combustion air nozzle 102 and is ejected through the opening 102*b* to the outer side of the fuel gas. The secondary air flows in the secondary air flow path P3 of the secondary air nozzle 103 and is ejected through the opening 103*e* to the outer side of the fuel gas combustion air. At this time, the fuel gas (pulverized coal and primary air), fuel gas combustion air, and secondary air are ejected as straight advancing flows in the burner axial line direction (along the center line O) without swirling.

Here, the fuel gas flows while branching off by the first member 111 and second members 112 at the opening 101*b* of the fuel nozzle 101, and ignites and combusts in this position to be combustion gas. The fuel gas combustion air ejected around the outer periphery of the fuel gas promotes combustion of the fuel gas. Furthermore, the secondary air ejected around the outer peripheries of the combustion flames adjusts the proportion of the fuel gas combustion air and the secondary air, enabling optimal combustion.

Each of the widened portions 122, 124 of the first member 111 and second members 112 constituting the inside member 104 has a splitting shape, so that the fuel gas flows along the guide surfaces 122*a*, 122*b*, 124*a* of the widened portions 122, 124 and then turns to the end surface 122*c*, 124*c* sides, thereby forming a recirculation region in front of the end surfaces 122*c*, 124*c*. Thus, ignition of the fuel gas and flame stabilizing are performed in this recirculation region, achieving inside flame stabilizing of the combustion flames. The outer peripheral portions of the combustion flames then have low temperatures, and the secondary air can reduce the temperatures of the combustion flames under a high-oxygen atmosphere, resulting in a reduction in NOx emission at the outer peripheral portions of the combustion flames.

The widened portion 122 of the first member 111 is positioned upstream of the widened portions 124 of the second members 112 in the ejected direction of the fuel gas. This configuration shifts the position of narrowing the fuel gas flow path P1 of the fuel nozzle 101 in the ejected direction of the fuel gas and reduces the flow rate of the fuel gas in the positions of the widened portions 122, 124. Thus, inside ignition and inside flame stabilizing can be enhanced without increasing the size of the fuel nozzle 101. The fuel gas forms a recirculation region with the guide surfaces 122*a*, 122*b* of the widened portion 122 of the first member 111, first. This recirculation region is formed in the fuel nozzle 101 and is thus difficult to receive radiant heat from an adjacent flame in the furnace, resulting in favorable inside ignition and inside flame stabilizing, efficient consumption of air from the inside of the fuel nozzle 101, and prevention of outside ignition. Next, after the recirculation region is formed with the guide surfaces 122*a*, 122*b* of the widened portion 122 of the first member 111, the fuel gas forms a recirculation region with the guide surfaces 124*a* of the widened portions 124 of the second members 112. Thus, the flow rate of the fuel gas is reduced between the widened portions 122, 124 of the members 111, 112, and the amount of the pulverized coal flowing toward the end surfaces 122*c*, 124*c* is increased. This can also enhance inside ignition and inside flame stabilizing.

The widened portions 124 of the second members 112 have the guide surfaces 124*a* only on the first member 111 sides and the flat shapes on the inner wall surface 101*a* sides of the fuel nozzle 101. This configuration does not allow a recirculation region to be formed in the second fuel gas flow paths P12, which do not have a flame stabilizing function, between the inner wall surfaces 101*a* of the fuel nozzle 101 and the second members 112, resulting in prevention of outside ignition. The secondary air nozzle 103 ejects the secondary air so as to surround the fuel nozzle 101 not only from above and below but also from the left and right, that is, over the entire periphery. It is thus difficult to form a high-temperature high-oxygen region partially in the circumferential direction, and the oxygen level is uniformized in the circumferential direction, resulting in a reduction in NOx emission at the outer peripheral portions of the combustion flames.

The combustion burner in the second embodiment is provided with the fuel nozzle 101 ejecting the fuel gas that is a mixture of the pulverized coal and air, the combustion air nozzle 102 ejecting air from the outer side of the fuel nozzle 101, and the inside member 104 including the first member 111 disposed on the axial line center O side in the fuel nozzle 101 and on the upstream side of the opening 101*b* of the fuel nozzle 101 in the ejected direction of the fuel gas and the second members 112 disposed at the opening 101*b* and on both inner wall surface 101*a* sides of the fuel nozzle 101 with respect to the first member 111 at predetermined intervals from the inner wall surfaces 101*a*.

Thus, the fuel gas flowing in the fuel nozzle 101 can maintain combustion of the fuel gas (pulverized coal) with the recirculation regions formed downstream of the members 111, 112. Here, since the first member 111 and second members 112 are shifted in position in the ejected direction of the fuel gas, the flow rate is reduced at the opening 101*b* of the fuel nozzle 101, resulting in an improvement in flame stability without increasing the size of the fuel nozzle 101. Ignition of the fuel gas and flame stabilizing are performed at the first member 111 and second members 112 in this order. Thus, the pulverized coal can be efficiently collected to thereby enhance inside flame stabilizing. Accordingly, inside flame stabilizing performance can be improved.

In the combustion burner in the second embodiment, the first member 111 and second members 112 are oriented in the horizontal direction and arranged at predetermined intervals in the vertical direction. This configuration in which the first member 111 and second members 112 are oriented in the horizontal direction can relatively weaken outer peripheral ignition in the vertical direction and thus reduce a high-temperature high-oxygen region due to air from the secondary air nozzle 103, which is typically disposed above and below. The configuration in which the first member 111 and second members 112 are oriented in the horizontal direction allows the secondary air nozzle main bodies 103*a*, 103*b*, which are typically disposed above and below in a corner firing type burner, to be disposed away from the fuel nozzle 101, resulting in a reduction in NOx emission at the outer peripheral portions of the combustion flames.

In the combustion burner in the second embodiment, the secondary air nozzle 103 is disposed above and below the fuel nozzle 101. This configuration allows the secondary air to be ejected outward of the second members 112, which do not have a flame stabilizing function on the outer side. Thus, even if these regions have excess oxygen, air can be supplied to the outer peripheries of the flames without increasing NOx emission. When a coal fuel, such as pulverized coal, is used, an air shortage may produce hydrogen sulfide, resulting in corrosion of the furnace wall. However, the secondary air nozzle 103 can sufficiently supply air to the outer peripheries of the flames and thus prevent hydrogen sulfide from being produced. Here, the secondary air nozzle 103 may be provided only above and below the fuel nozzle 101 without being provided at the left and right of the fuel nozzle 101.

The first member 111 and second members 112 described in the present embodiment both function as flame stabilizers; however, each of the members may function as a guide member guiding the pulverized coal toward another member without functioning as a flame stabilizer. For example, when the pulverized coal is guided from the first member 111 toward the second members 112, the first member 111 functions as a guide member. In this case, the first member 111 may not function as a flame stabilizer. When the pulverized coal is supplied from the second members 112 to the recirculation region at the first member 111, the second members 112 function as guide members. In this case, the second members 112 may not function as flame stabilizers.

Modified Examples

Figure 7:
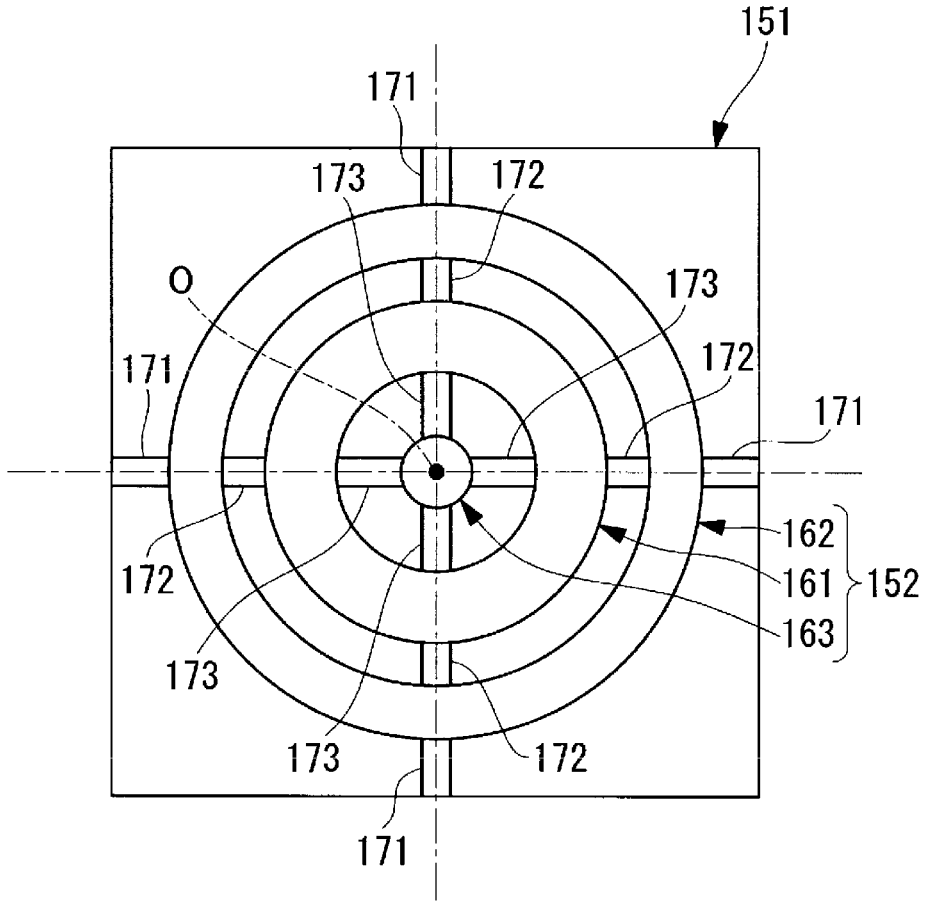
FIG. 7 is a front view illustrating a first modified example of the combustion burner.
Figure 8:
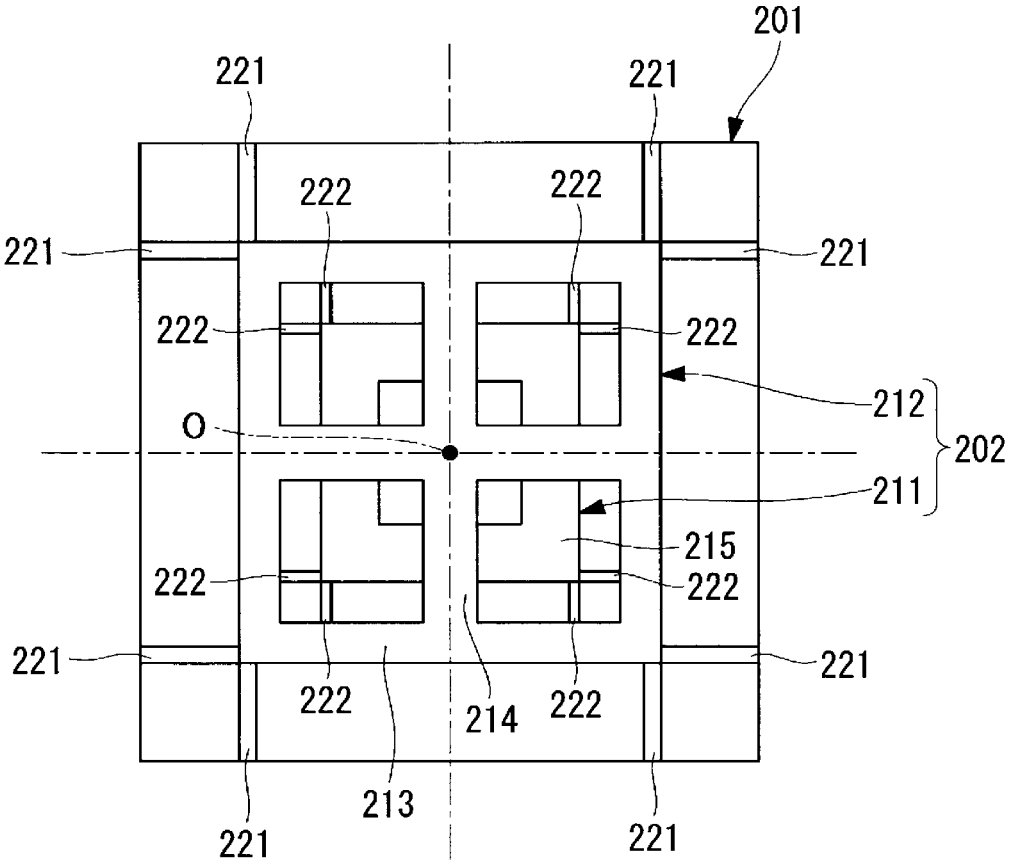
FIG. 8 is a front view illustrating a second modified example of the combustion burner.

FIG. 7 is a front view illustrating a first modified example of the combustion burner, and FIG. 8 is a front view illustrating a second modified example of the combustion burner.

The inside members 64, 104 have rod shapes in a front view in the above-described first and second embodiments but may have other shapes. The inside member may have a ring shape or a lattice shape as described below. The inside member desirably has an inner side disposed relatively upstream in addition to being oriented in the vertical direction or the horizontal direction.

As illustrated in FIG. 7, a fuel nozzle 151 has a rectangular shape and is provided with an inside member 152 disposed at a distal end, that is, downstream in the flow direction of the fuel gas. The inside member 152 functions as a member for igniting the fuel gas and stabilizing flames or guiding the fuel in the fuel nozzle 151. The inside member 152 is constituted by a first member 161, a second member 162, and a third member 163. The second member 162 is disposed at the distal end of the fuel nozzle 151 at predetermined intervals (gaps) from inner wall surfaces of the fuel nozzle 151, and has a circular ring shape with the axial line (the center line of the fuel nozzle 151) O in the ejected direction of the fuel gas being the center. The first member 161 is disposed at predetermined intervals (gaps) inside the second member 162, and has a circular ring shape with the axial line O in the ejected direction of the fuel gas being the center. The third member 163 is disposed at predetermined intervals (gaps) inside the first member 161, and has a cylindrical shape on the axial line O in the ejected direction of the fuel gas.

The second member 162 is supported, at the outer peripheral portion, by the inner wall surfaces of the fuel nozzle 151 through a plurality of (four, in the present modified example) support members 171. The first member 161 is supported, at the outer peripheral portion thereof, by the second member 162 through a plurality of (four, in the present modified example) support members 172. The third member 163 is supported, at the outer peripheral portion, by the first member 161 through a plurality of (four, in the present modified example) support members 173.

The first, second, and third members 161, 162, 163 are each provided with a widened portion at the distal end, which is not illustrated. As in the first and second embodiments, the end surfaces of the widened portions of the second and third members 162, 163 are arranged in the same position as the opening of the fuel nozzle 151 in the flow direction of the fuel gas so as to be aligned on the same plane. The end surface of the widened portion of the first member 161 is arranged in a position remote from the opening of the fuel nozzle 151 toward the upstream side in the ejected direction of the fuel gas by a predetermined distance.

In the first modified example, inside ignition can be expanded (propagated) from the inside toward the outer side of the combustion burners in the same way in the vertical direction and the horizontal direction, resulting in efficient inside flame stabilizing.

The inside member may have a polygonal ring shape, such as a square ring shape, or an oval ring shape other than a circular ring shape. The members having mutually different shapes, such as a square ring shape and a circular ring shape, may be combined instead of a combination of the members having the same shape. The number of the members combined as the inside member may be one, two, or four or more other than three.

As illustrated in FIG. 8, a fuel nozzle 201 has a rectangular shape and is provided with an inside member 202 at a distal end, that is, downstream in the flow direction of the fuel gas. The inside member 202 functions as a member for igniting the fuel gas and stabilizing flames or guiding the fuel in the fuel nozzle 201. The inside member 202 is constituted by a first member 211 and a second member 212. The second member 212 is constituted by a frame 213 having a rectangular ring shape with the axial line (the center line of the fuel nozzle 201) O in the ejected direction of the fuel gas being the center in a front view, and a connection 214 integrally provided inside the frame 213 and having a cross shape in a front view. The frame 213 is disposed at the distal end of the fuel nozzle 201 at predetermined intervals (gaps) from inner wall surfaces of the fuel nozzle 201. The first member 211 includes a frame 215 disposed at predetermined intervals (gaps) inside the frame 213 of the second member 212. The frame 215 has a rectangular ring shape with the axial line O in the ejected direction of the fuel gas being the center. Here, the first member 211 and the connection 214 of the second member 212 intersect each other.

The second member 212 is supported, at the outer peripheral portion, by the inner wall surfaces of the fuel nozzle 201 through a plurality of (eight, in the present modified example) support members 221. The first member 211 is supported, at the outer peripheral portion, by the frame 213 of the second member 212 through a plurality of (eight, in the present modified example) support members 222.

The first and second members 211, 212 are each provided with a widened portion at the distal end, which is not illustrated. As in the first and second embodiments, the end surface of the widened portion of the second member 212 is arranged in the same position as the opening of the fuel nozzle 201 in the flow direction of the fuel gas so as to be aligned on the same plane. The end surface of the widened portion of the first member 211 is arranged in a position remote from the opening of the fuel nozzle 201 toward the upstream side in the ejected direction of the fuel gas by a predetermined distance.

In the second modified example, inside ignition can be expanded (propagated) from the inside toward the outer side of the combustion burners in the same way in the vertical direction and the horizontal direction, resulting in efficient inside flame stabilizing.

As described above, the combustion burner of the present invention does not depend on the shape of the inside member, and a plurality of members may be arranged in the width direction, the height direction, or the radial direction with respect to the central axis in the fuel nozzle.

Figure 9:
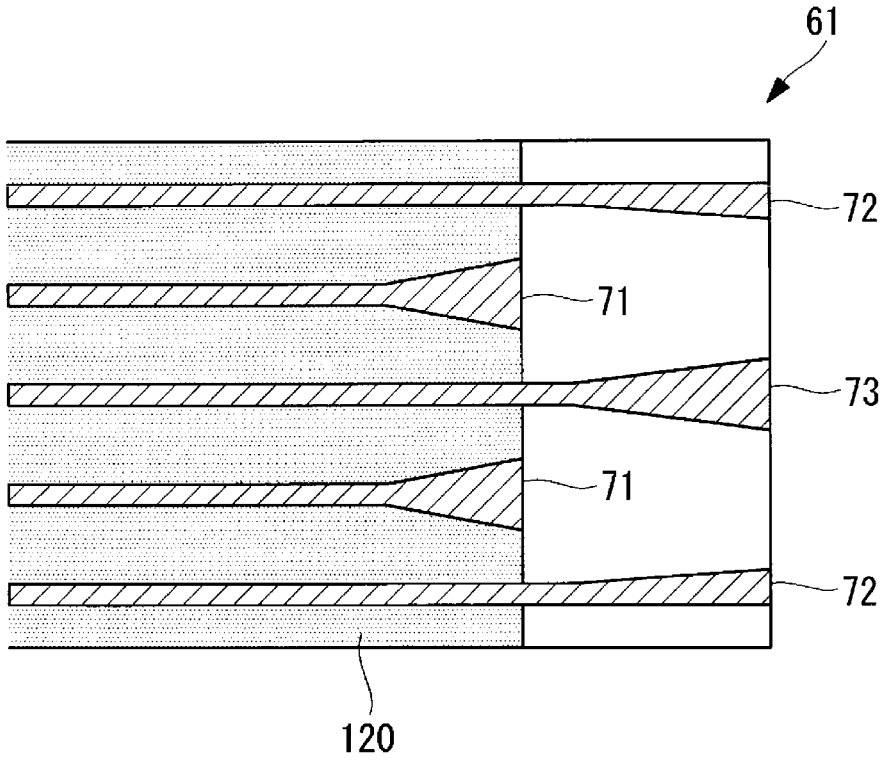
FIG. 9 is a horizontal cross-sectional view illustrating a third modified example of the combustion burner.
Figure 10:
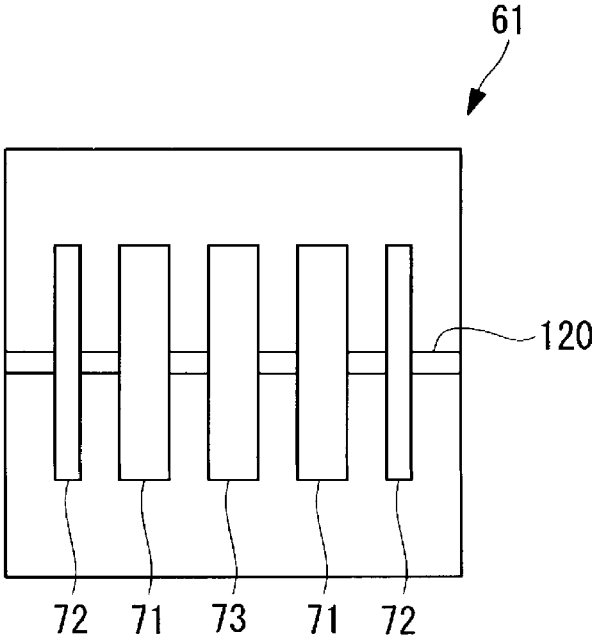
FIG. 10 is a front view of the combustion burner illustrated in FIG. 9.

A third modified example will now be described. As illustrated in FIGS. 9 and 10, in the present modified example, a rectifying plate 120 is provided inside the fuel nozzle 61. In the present modified example, components common to the first embodiment are given the same reference signs, and explanations thereof are omitted.

As illustrated in FIGS. 9, and 10, the rectifying plate 120 is a planar object disposed at the center in the height direction of the fuel nozzle 61 and extending in the horizontal direction from the left portion (first end portion) of the fuel nozzle 61 being the upstream side of the fuel gas flow to the right portion (second end portion) being the downstream side. This configuration allows the rectifying plate 120 to divide the flow path in the fuel nozzle 61 into two sections in the vertical direction. As illustrated in FIG. 9, the downstream end (right end in the same drawing) of the rectifying plate 120 in the fuel gas flow direction is in the same position as the downstream ends of the first members 71.

The rectifying plate 120 arranged as described above enables the angle of the fuel gas flow to be adjusted along the rectifying plate 120 even if the angle of the fuel nozzle 61 is adjusted in the vertical direction (vertical direction in FIG. 10). This can yield a desired flow.

The position of the downstream end of the rectifying plate 120 may be further moved downstream (to the right side in FIG. 9) in the fuel gas flow. This configuration can guide the fuel gas flow downstream and can thus yield a more desired flow. However, if the downstream end of the rectifying plate 120 is positioned downstream, it is close to the ignition position and may be burn-damaged. Thus, the position of the downstream end of the rectifying plate 120 is required to be determined so that burn-damage does not occur.

Figure 11:
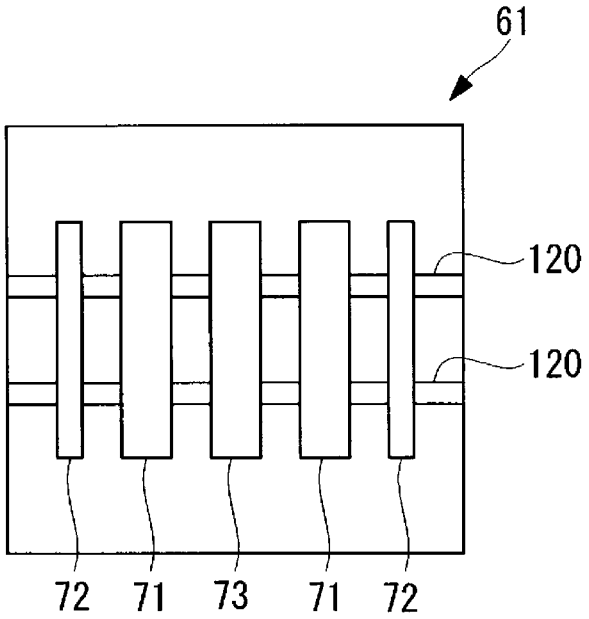
FIG. 11 is a front view illustrating a modified example of arrangement of rectifying plates in FIG. 9.
Figure 12:
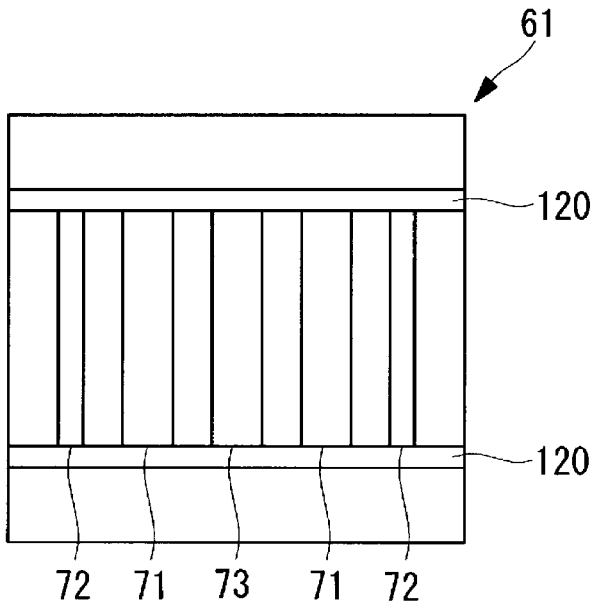
FIG. 12 is a front view illustrating a modified example of arrangement of rectifying plates in FIG. 9.

Instead of providing one rectifying plate 120 at the center in the height direction of the fuel nozzle 61, two rectifying plates 120 may be provided above and below the center in the height direction of the fuel nozzle 61 as illustrated in FIG. 11 or at the upper and lower ends of the members 71, 72, 73 as illustrated in FIG. 12. Alternatively, three or more rectifying plates 120 may be provided, which is not illustrated.

In the above-described first embodiment, the inside member is constituted by two first members, two second members, and a third member. In the second embodiment, the inside member is constituted by a first member and two second members. However, no such limitation is intended. The number of the first members may be three or more instead of one or two. The second members are desirably provided on the outermost sides of the inside member in the fuel nozzle. Two or more second members may be provided. The third member may not be provided. The third member is desirably provided on the innermost side of the inside member in the fuel nozzle. Two or more third members may be provided. The third member may be disposed in the same position as the first members in the ejected direction of the fuel gas. In this case, inside flame stabilizing effect can be enhanced.

In the above-described embodiments, each of the members of the inside member is constituted by the flat portion and the widened portion. However, no such limitation is intended, and the member may be constituted only by the widened portion.

In the above-described embodiments, the fuel nozzle, combustion air nozzle, and secondary air nozzle are rectangular. However, no such limitation is intended, and the nozzles may be circular.

If two rectifying plates 120 are provided at the upper and lower ends of the members 71, 72, 73 as illustrated in FIG. 12, the configuration may be modified as illustrated in FIGS. 13 to 16.

Figure 13:
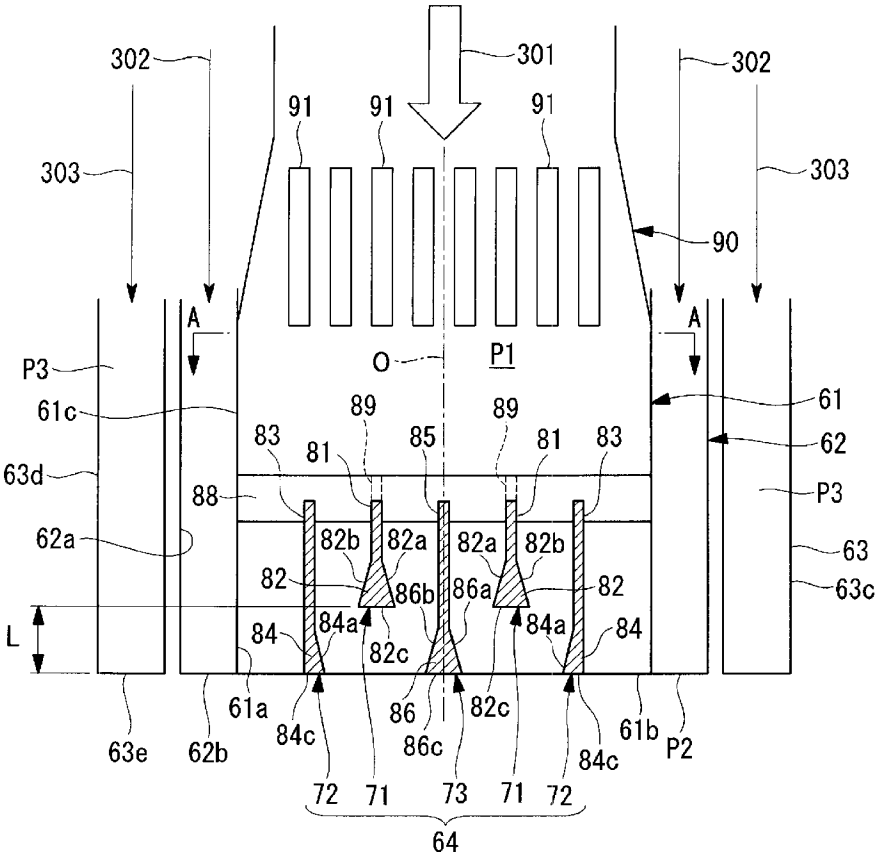
FIG. 13 is a horizontal cross-sectional view illustrating a combustion burner in a modified example of that illustrated in FIG. 12.
Figure 16:
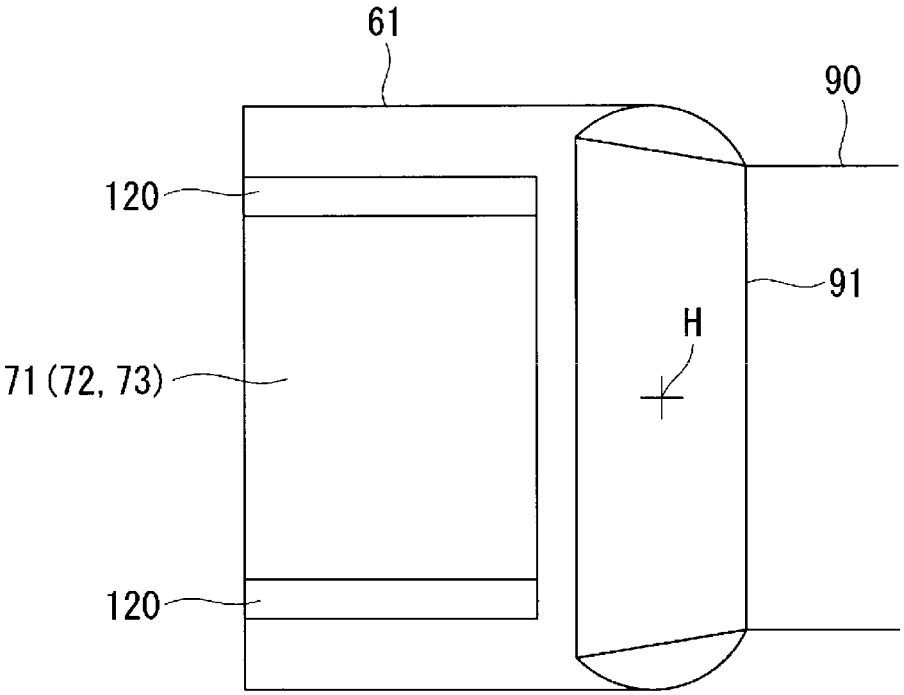
FIG. 16 is a horizontal cross-sectional view of the combustion burner illustrated in FIG. 13, cut vertically.

As illustrated in FIG. 13, the distal end being the downstream end of a pulverized coal tube 90 is connected to the upstream side of the fuel nozzle 61 in the fuel gas flow direction. As illustrated in FIG. 16, the fuel nozzle 61 can rock about the horizontal axial line H.

Figure 14:
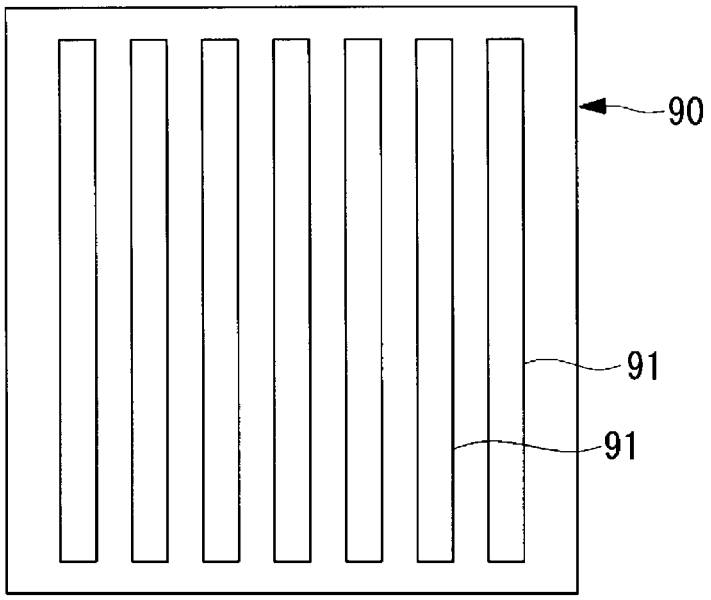
FIG. 14 is a horizontal cross-sectional view of the combustion burner, taken along the line A-A in FIG. 13.
Figure 15:
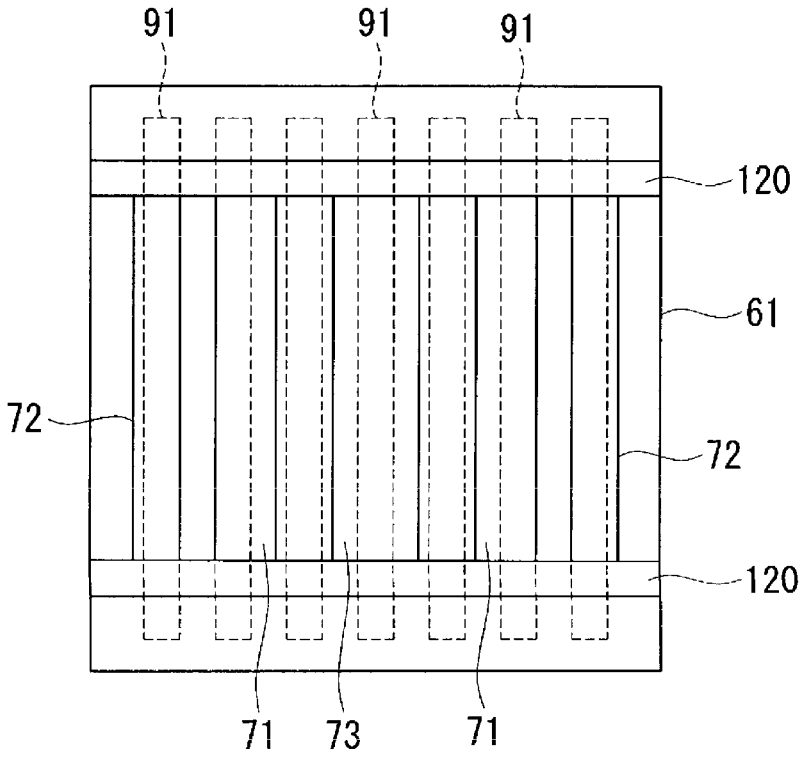
FIG. 15 is a front view of the combustion burner illustrated in FIG. 13.

The pulverized coal tube 90 is provided with a plurality of plate members 91 at the distal end as illustrated in FIG. 13. As illustrated in FIGS. 14, 15, the plate members 91 are oriented in the vertical direction and arranged at predetermined intervals in the horizontal direction in the same manner as the members 71, 72, 73. The plate members 91 are provided so as to extend substantially over the entire vertical flow path width of the pulverized coal tube 90. The plate members 91 disposed at the distal end of the pulverized coal tube 90 can rectify the fuel gas flow. In addition, the plate members 91 occupying the flow path at the distal end of the pulverized coal tube 90 can reduce the cross-sectional area of the flow path of the pulverized coal tube 90. This configuration can prevent a decrease in the flow rate at the distal end of the pulverized coal tube 90 even if the size of the pulverized coal tube 90 is increased and can thus prevent the solid fuel (pulverized coal) in the fuel gas from being accumulated at the distal end of the pulverized coal tube 90 or upstream of the fuel gas flow in the fuel nozzle.

In particular, to expand the cross-sectional area of the flow path of the fuel nozzle 61, the structure in which the distal end of the pulverized coal tube 90 is expanded toward the downstream side as illustrated in FIG. 16 may be used. Even if the distal end of the pulverized coal tube 90 is expanded in this way, the plate members 91 provided as described above can adjust the cross-sectional area of the flow path and set the flow rate of the fuel gas to a desired value.

Figure 17:
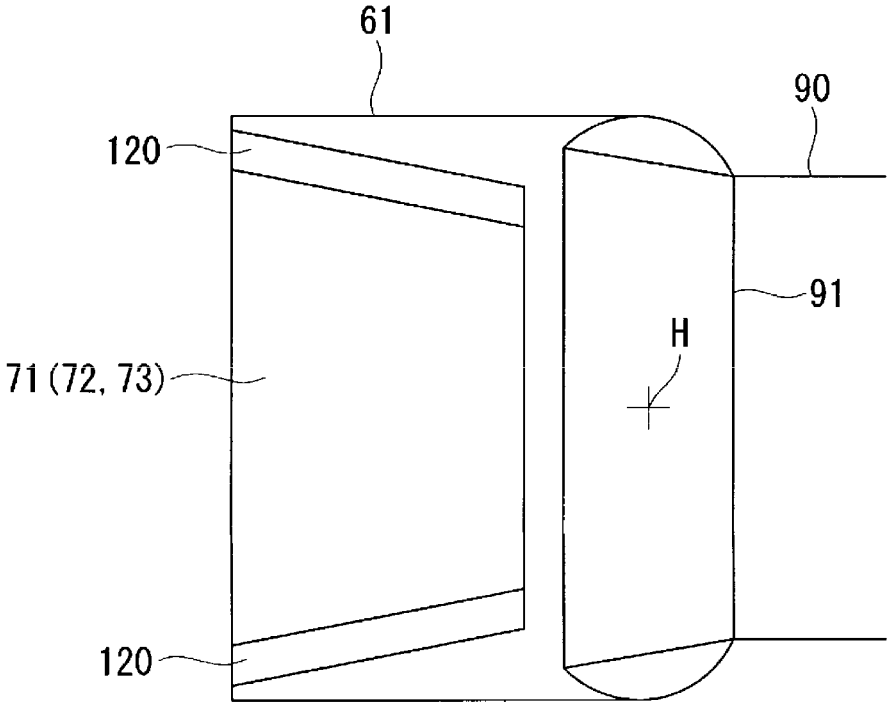
FIG. 17 is a horizontal cross-sectional view illustrating a modified example of the combustion burner illustrated in FIG. 13.

As illustrated in FIG. 17, the members 71, 72, 73 disposed in the fuel nozzle 61 may be expanded toward the downstream side of the fuel gas flow. Accordingly, the upper and lower rectifying plates 120 also expand toward the downstream side of the fuel gas flow. This configuration reduces the flow rate of the fuel gas flowing along the members 71, 72, 73, resulting in a further improvement in the flame stabilizing function.

The plate members 91 and the members 71, 72, 73 are oriented in the vertical direction in FIG. 13 to FIG. 17 but may be oriented in the horizontal direction. In this case, the rectifying plates 120 are oriented in the vertical direction.

The boiler of the present invention is a coal-fired boiler in the above-described embodiments but may be a boiler using a solid fuel, such as biomass, petroleum coke, and residual petroleum. The boiler can also be applied to an oil-fired boiler using heavy oil as the fuel instead of a solid fuel. Furthermore, the boiler can also be applied to a multi-fuel fired boiler using these fuels.

In the combustion burner of the present invention, the fuel nozzle, combustion air nozzle, and secondary air nozzle are not necessarily arranged in parallel. The secondary air nozzle may be arranged obliquely so that the fuel nozzle and secondary air nozzle gradually separate from each other toward the distal end of the combustion burner. In this case, the distance between the fuel nozzle and the secondary air nozzle in the vicinity of the ejection opening of the fuel nozzle is required to be maintained so that the fuel gas flow is not disturbed. The secondary air nozzle arranged obliquely reduces the amount of air at the outer periphery of ignition and prevents outside flame stabilizing in the fuel nozzle, resulting in a further NOx reduction.

REFERENCE SIGNS LIST

10 Coal-fired boiler
11 Furnace
12 Combustion device
13 Flue
21, 21A, 22, 23, 24, 25 Combustion burner
26, 27, 28, 29, 30 Pulverized coal supply tube
31, 32, 33, 34, 35 Coal pulverizer
36 Wind box
37 Air duct
39 Additional air nozzle
40 Branching air duct
51, 52, 53 Superheater
54, 55 Reheater
56, 57 Fuel economizer
61, 101, 151, 201 Fuel nozzle
61*a*, 101*a* Inner wall surface
61*b*, 62*b*, 63*e*, 101*b*, 102*b*, 103*e* Opening (Nozzle hole opening)
62, 102 Combustion air nozzle

63, 103 Secondary air nozzle
64, 104, 152, 202 Inside member
71, 111, 161, 211 First member
72, 112, 162, 212 Second member
73, 163 Third member
81, 83, 85, 121, 123 Flat portion
82, 84, 86, 122, 124 Widened portion (Flame stabilizing section)
82*a*, 84*a*, 86*a*, 122*a*, 124*a* First guide surface
82*b*, 86*b*, 122*b* Second guide surface
82*c*, 84*c*, 86*c*, 122*c*, 124*c* End surface
87, 88, 125, 126, 171, 172, 173, 221 222 Support member
120 Rectifying plate
P1 Fuel gas flow path
P11 First fuel gas flow path
P12 Second fuel gas flow path
P13 Third fuel gas flow path
P2 Combustion air flow path
P3 Secondary air flow path

The invention claimed is:

1. A combustion burner comprising:

a fuel nozzle ejecting a fuel gas being a mixture of fuel and air;

a combustion air nozzle ejecting air from an outer side of the fuel nozzle;

a first member arranged inside the fuel nozzle and comprising a first inclined surface inclined with respect to a flow of the fuel gas and a first inclination end edge, the first inclined surface ending inclination at the first inclination end edge; and second members arranged downstream of the first inclination end edge in a direction of the fuel gas flow and each comprising a second inclined surface inclined toward the first member with respect to the fuel gas flow and a second inclination end edge, the second inclined surface ending inclination at the second inclination end edge;

the second members being disposed on both sides of the first member, wherein the second members are disposed in a vicinity of an opening of the fuel nozzle at predetermined intervals from inner wall surfaces of the fuel nozzle.

2. The combustion burner according to claim 1, wherein:

the first member comprises a plurality of the first inclined surfaces spreading an ejected direction of the fuel gas in at least two directions; and the second members each comprise the second inclined surface disposed only on a side close to the first member.

3. The combustion burner according to claim 2, further comprising a third member disposed downstream of the first inclination end edge in the fuel gas flow direction between a plurality of the first members, the third member comprising third inclined surfaces inclined toward the first members with respect to the fuel gas flow and third inclination end edges, the third inclined surfaces ending inclination at the third inclination end edges.

4. The combustion burner according to claim 1, wherein the first member is provided so that a position thereof is adjustable in the fuel gas flow direction.

5. The combustion burner according to claim 1, wherein the first member and the second members are oriented in a vertical direction and arranged at predetermined intervals in a horizontal direction.

6. The combustion burner according to claim 1, wherein the first member and the second members are oriented in the horizontal direction and arranged at predetermined intervals in the vertical direction.

7. The combustion burner according to claim 5, further comprising secondary air nozzles ejecting air from the outer side of the combustion air nozzle and disposed at least on both sides in an inclination direction of the first inclined surface of the first member in the fuel nozzle.

8. The combustion burner according to claim 5, further comprising a rectifying plate extending from a first end portion to a second end portion of the fuel nozzle.

9. The combustion burner according to claim 8, wherein a plurality of the rectifying plates are disposed at both ends of the first member and the second members in the fuel gas flow direction so as to face each other.

10. The combustion burner according to claim 9, wherein a distance between the facing rectifying plates gradually expands toward a downstream side in the fuel gas flow direction.

11. The combustion burner according to claim 8, further comprising a pulverized coal tube connected with an upstream end of the combustion air nozzle, the pulverized coal tube having a distal end formed so that a cross-sectional area of a flow path expands toward the downstream side in the fuel gas flow direction, and the pulverized coal tube comprising a plurality of plate members at the distal end.

12. A boiler comprising:

a furnace that is hollow and installed in a vertical direction;

the combustion burner according to claim 1, disposed at the furnace; and a flue disposed at an upper portion of the furnace.

13. The boiler according to claim 12, further comprising an additional air supplier disposed above the combustion burner at the furnace.

* * * * *